US008857391B2

(12) United States Patent
Nakashima

(10) Patent No.: US 8,857,391 B2
(45) Date of Patent: Oct. 14, 2014

(54) CONTROLLER FOR VARIABLE VALVE ACTUATION DEVICE

(75) Inventor: Toyokazu Nakashima, Mie-ken (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 195 days.

(21) Appl. No.: 13/637,871

(22) PCT Filed: Sep. 27, 2011

(86) PCT No.: PCT/JP2011/072061

§ 371 (c)(1),
(2), (4) Date: Sep. 27, 2012

(87) PCT Pub. No.: WO2013/046332

PCT Pub. Date: Apr. 4, 2013

(65) Prior Publication Data

US 2013/0074791 A1 Mar. 28, 2013

(51) Int. Cl.

| | |
|---|---|
| ***F01L 1/34*** | (2006.01) |
| ***F01L 1/344*** | (2006.01) |
| *F01L 1/053* | (2006.01) |
| *F01L 1/18* | (2006.01) |
| *F01L 1/24* | (2006.01) |

(52) U.S. Cl.

CPC ..... *F01L 1/3442* (2013.01); *F01L 2800/03* (2013.01); *F01L 2001/0537* (2013.01); *F01L 2001/34466* (2013.01); *F01L 2250/02* (2013.01); *F01L 1/185* (2013.01); *F01L 2001/34476* (2013.01); *F01L 1/2405* (2013.01); *F01L 2001/34469* (2013.01)

USPC ..... 123/90.17; 123/90.12

(58) Field of Classification Search

USPC ..... 123/90.12, 90.15, 90.16, 90.17; 464/160, 161

See application file for complete search history.

(56) References Cited

U.S. PATENT DOCUMENTS

| | | | | |
|---|---|---|---|---|
| 5,797,361 | A | 8/1998 | Mikame et al. | |
| 2002/0014215 | A1 * | 2/2002 | Ishii et al. | 123/90.17 |
| 2010/0212615 | A1 | 8/2010 | Suzuki et al. | |
| 2011/0214634 | A1 * | 9/2011 | Yamaguchi et al. | 123/90.17 |
| 2014/0083383 | A1 * | 3/2014 | Fujiyoshi et al. | 123/90.15 |

FOREIGN PATENT DOCUMENTS

| | | | |
|---|---|---|---|
| JP | 9-324612 | A | 12/1997 |
| JP | 2006-170085 | A | 6/2006 |
| JP | 2009-24659 | A | 2/2009 |
| JP | 2010-203315 | A | 9/2010 |
| JP | 2010-223212 | A | 10/2010 |
| JP | 2010-261312 | A | 11/2010 |
| JP | 2011-185100 | A | 9/2011 |

* cited by examiner

*Primary Examiner* — Thomas Denion
*Assistant Examiner* — Daniel Bernstein
(74) *Attorney, Agent, or Firm* — Sughrue Mion, PLLC

(57) ABSTRACT

A controller for a variable valve actuation device is provided. The controller prevents the startability of an internal combustion engine from being degraded. An electronic controller (91) performs a phase advancing control at engine starting to advance valve timing (VT) by oil pressure of an phase advancing chamber (37) and oil pressure of a phase retarding chamber (38) provided in a phase changing mechanism (30) if a residual oil amount (Q) is greater than or equal to a reference oil amount (QA) at engine starting. In addition, when the valve timing (VT) reaches an intermediate angular phase (VTmdl), the valve timing (VT) is held in the intermediate angular phase (VTmdl) by oil pressure of the phase changing mechanism (30).

8 Claims, 7 Drawing Sheets

CONTROLLER FOR VARIABLE VALVE ACTUATION DEVICE

CROSS REFERENCE TO RELATED APPLICATIONS

This application is a National Stage of International Application No. PCT/JP2011/072061 filed Sep. 27, 2011 the contents of all of which are incorporated herein by reference in their entirety.

FIELD OF THE INVENTION

The present invention relates to a controller for a variable valve actuation device that comprises a hydraulic phase changing mechanism, a phase locking mechanism for locking the valve timing to a specific angular phase that is more advanced than the most retarded phase, and an independent phase advancing mechanism for advancing the valve timing from the most retarded phase to a specific angular phase in accordance with cam torque variations.

BACKGROUND OF THE INVENTION

As the above variable valve actuation device, a variable valve actuation device described in Patent Document 1 has been known.

In the variable valve actuation device of this document, at the starting of an engine at which the valve timing is not locked to a specific angular phase, an advance of the valve timing due to cam torque variations is used to lock the valve timing to a specific angular phase.

PRIOR ART DOCUMENT

Patent Document

Patent Document 1: Japanese Laid-Open Patent Publication No. 2009-24659

SUMMARY OF THE INVENTION

In an internal combustion engine provided with the above variable valve actuation device, a resistance force against advance of the valve timing due to cam torque variations at the starting of the engine increases as the amount of hydraulic oil or the pressure of hydraulic oil remaining in a phase retarding chamber of the phase changing mechanism becomes greater.

Therefore, if the amount of hydraulic oil or the pressure of hydraulic oil remaining in a phase retarding chamber is great, the startability of the internal combustion engine may deteriorate due to an unreasonably prolonged period of time required for the valve timing to reach a specific angular phase after the starting of the engine is initiated.

Accordingly, it is an objective of the present invention to provide a controller for a variable valve actuation device that prevents the startability of an internal combustion engine from being deteriorating.

The present invention provides a controller for a variable valve actuation device. The variable valve actuation device includes a hydraulic phase changing mechanism for changing valve timing of an internal combustion engine by selectively supplying and discharging hydraulic oil to and from an phase advancing chamber and a phase retarding chamber, a phase locking mechanism for locking the valve timing to a specific angular phase that is more advanced than the most retarded phase, and an independent phase advancing mechanism for advancing the valve timing in accordance with cam torque variations from the most retarded phase to the specific angular phase. The amount of hydraulic oil remaining in the phase retarding chamber is defined as a residual oil amount and the pressure of hydraulic oil remaining in the phase retarding chamber is defined as a residual oil pressure. The controller allows a greater amount of hydraulic oil to be supplied to the phase advancing chamber when the residual oil amount or the residual oil pressure is large at engine starting in comparison with a case in which the residual oil amount or the residual oil pressure is small at engine starting.

A resistance force against advancement of the valve timing due to cam torque variations occurring at the starting of the engine changes under the influence of the amount of residual oil or the pressure of residual oil. In other words, the above resistance force increases as the amount of residual oil or the pressure of residual oil becomes greater at the starting of the engine.

According to the present invention, when the amount of residual oil or the pressure of residual oil is large at the starting of the engine, a greater amount of hydraulic oil is supplied to a phase advancing chamber in comparison with a case in which the amount of residual oil or the pressure of residual oil is small at the starting of the engine. As a result, when the amount of residual oil or the pressure of residual oil is large at the starting of the engine, a greater force is applied to advance the valve timing in comparison with a case with a small amount of residual oil or a small pressure of residual oil at the starting of the engine. As a result, deterioration of the startability due to hydraulic oil remaining in the phase retarding chamber is inhibited.

The controller for a variable valve actuation device preferably increases the amount of hydraulic oil supplied to the phase advancing chamber when the residual oil amount or the residual oil pressure is greater than or equal to a reference value at engine starting in comparison with a case in which the residual oil amount or the residual oil pressure is less than the reference value at engine starting.

The controller for a variable valve actuation device is preferably configured such that, after the starting of the internal combustion engine is initiated under a circumstance in which the residual oil amount or the residual oil pressure is less than the reference value, the phase locking mechanism locks the valve timing to the specific angular phase when the valve timing is advanced to the specific angular phase due to the cam torque variations.

According to the present invention, the valve timing is locked to a specific angular phase by the phase locking mechanism at the starting of the engine and therefore, the valve timing is accompanied by a smaller variation width in comparison with a structure without locking the valve timing by the phase locking mechanism at the starting of the engine.

The controller for a variable valve actuation device is preferably configured such that an operating state of the phase locking mechanism in which the valve timing is not locked to the specific angular phase is defined as a phase unlocking state, and that the phase locking mechanism is preferably in the phase unlocking state if the residual oil amount or the residual oil pressure is greater than or equal to the reference value at engine starting.

The controller for a variable valve actuation device is preferably configured such that a predetermined phase range that is a more advanced than the most retarded phase and includes the specific angular phase is defined as a specific phase range, and that, after the starting of the internal combustion engine is initiated under a circumstance in which the residual oil amount or the residual oil pressure is greater than or equal to the reference value, the valve timing is held in the specific phase range by oil pressure of the phase changing mechanism when the valve timing is advanced to the specific phase range.

According to the present invention, the valve timing is held in a specific phase range by oil pressure of the phase changing mechanism at the starting of the engine and therefore, the startability of the internal combustion engine is enhanced in comparison with a structure in which the valve timing is held in a more retarded phase than the specific phase range at the starting of the engine.

The controller for a variable valve actuation device is preferably configured such that the controller estimates at least one of the residual oil amount and the residual oil pressure at the starting of the engine based on a variation width of the valve timing at the starting of the engine.

The valve timing shows a different variation width at the starting of the engine depending on the amount of residual oil or the pressure of residual oil at the starting of the engine. It is therefore possible based on a variation width of the valve timing at the starting of the engine to estimate at least one of the amount of residual oil and the pressure of residual oil at the starting of the engine.

The controller for a variable valve actuation device is preferably configured such that a history showing that a variation width of the valve timing is greater than or equal to a predetermined variation width at the last engine stopping transition is defined as a history at engine stopping, and that, after the current starting of the internal combustion engine is initiated, the phase locking mechanism locks the valve timing to the specific angular phase if the valve timing is advanced to the specific angular phase due to the cam torque variations and there is the history at engine stopping.

The variation width of the valve timing shows in the transition to stopping of the engine increases as the amount of residual oil and the pressure of residual oil become smaller. Accordingly, if the valve timing is accompanied by a large variation width in the last transition to stopping of the engine, it is estimated that at least either the amount of residual oil amount or the pressure of residual oil is small at the current starting of the engine.

Therefore, in the above invention, if there is a history at engine stopping, the valve timing is advanced by cam torque variations at the current starting of the engine and the valve timing is locked to a specific angular phase by the phase locking mechanism. As a result, in comparison with a structure in which the valve timing is advanced by oil pressure control of the phase changing mechanism if at least either the amount of residual oil or the pressure of residual hydraulic is small at the starting of the engine, the valve timing is locked to a specific angular phase in an early stage more frequently.

The controller for a variable valve actuation device is preferably configured such that the controller estimates at least one of the residual oil amount and the residual oil pressure at the starting of the engine based on at least one of the residual oil amount and the residual oil pressure at the last stopping of the engine, and based on the outflow of hydraulic oil from the phase retarding chamber in a period from the last stopping of the engine to the starting of the engine.

In a period in which the internal combustion engine stops rotating, that is, in a period from the last stopping of the engine to the current starting of the engine, hydraulic oil remaining in the phase retarding chamber when the engine was stopped flows from a clearance of the phase changing mechanism to the outside. It is therefore possible to estimate, based on the amount of residual oil at the last stopping of the engine and the outflow of hydraulic oil in a period in which the internal combustion engine stops rotating, at least either the amount of residual oil or the pressure of residual oil at the starting of the engine.

DETAILED DESCRIPTION OF THE PREFERRED EMBODIMENTS

Figure 1:
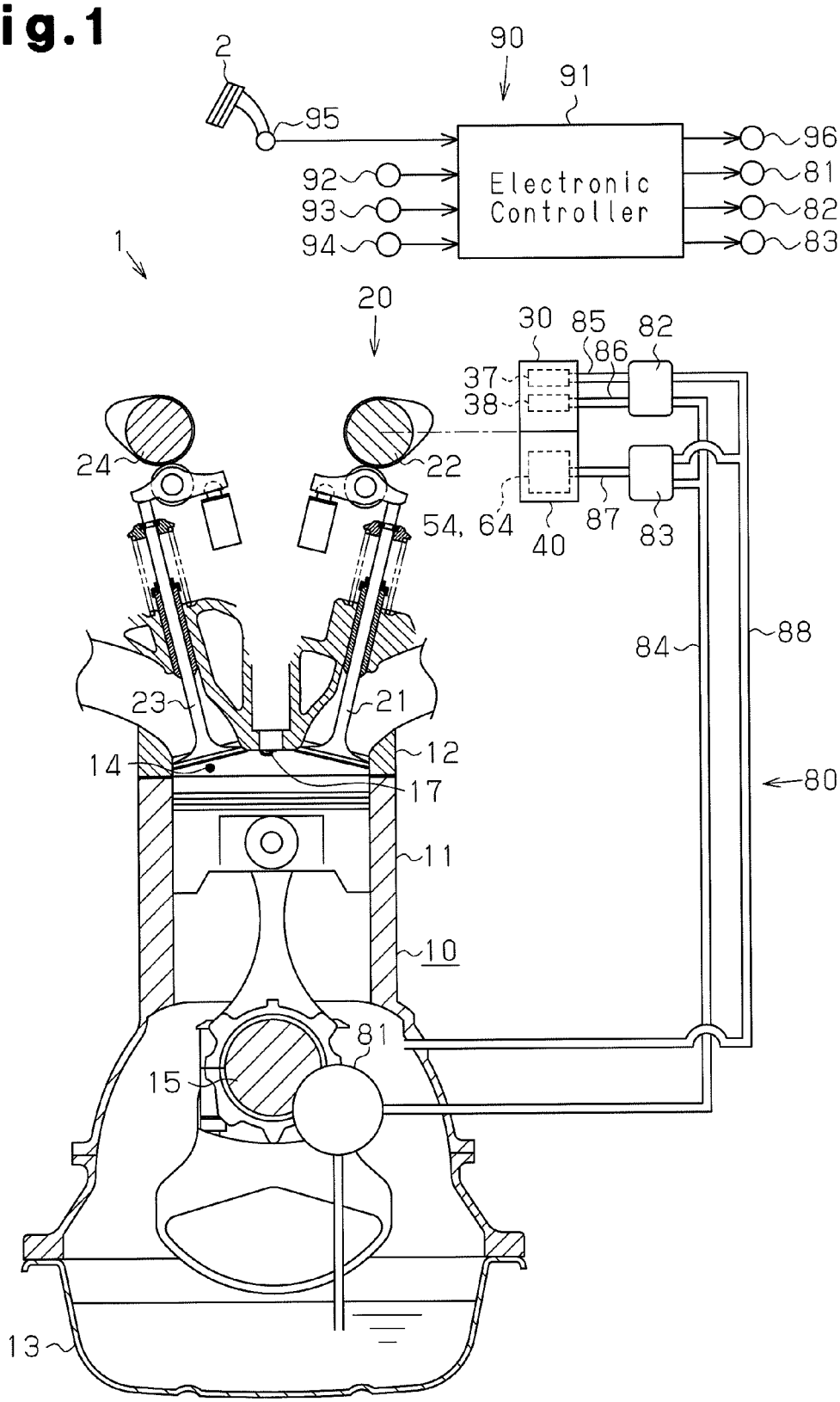
FIG. 1 is a schematic diagram showing the structure of an internal combustion engine that comprises a controller for a variable valve actuation device according to one embodiment of the present invention.

With reference to FIG. 1, the structure of an internal combustion engine 1 will be described.

The internal combustion engine 1 has an engine main body 10 for allowing a crankshaft 15 to be rotated by combustion of air-fuel mixture, a variable valve actuation device 20 provided with respective elements of a valve operating system, a hydraulic mechanism 80 for supplying hydraulic oil to the engine main body 10 and other parts, and a controller 90 for integrally controlling various kinds of devices including these devices.

The engine main body 10 includes a cylinder block 11, in which air-fuel mixture undergoes combustion, a cylinder head 12, to which the variable valve actuation device is assembled, and an oil pan 13 for storing hydraulic oil, which is supplied to respective parts of the engine main body 10.

The variable valve actuation device 20 includes an intake valve 21 for opening and closing an intake port of a combustion chamber 14, an exhaust valve 23 for opening and closing an exhaust port of the combustion chamber 14, an intake camshaft 22 for pushing down the intake valve 21, and an exhaust camshaft 24 for pushing down the exhaust valve 23. In addition to these components, the variable valve actuation device 20 includes a hydraulic phase changing mechanism 30 for changing the rotational phase of the intake camshaft 22 relative to the rotational phase of the crankshaft 15 (referred to as valve timing VT hereinafter), and a phase locking mechanism 40 for locking the valve timing VT.

The phase changing mechanism 30 switches the valve timing VT in a range from valve timing on the most advanced phase (referred to as the most advanced phase VTmax hereinafter) to valve timing on the most retarded phase (referred to as most retarded phase VTmin hereinafter).

The phase locking mechanism 40 locks the valve timing VT to specific valve timing that falls in a range between the most advanced phase VTmax and the most retarded phase VTmin (referred to as intermediate angular phase VTmdl hereinafter). The intermediate angular phase VTmdl corresponds to specific angular phase.

As for the intermediate angular phase VTmdl, the valve timing VT is set so that the internal combustion engine 1 can be started in cold districts. When the valve timing VT at the starting of the internal combustion engine 1 is compared between a case of being set to the intermediate angular phase VTmdl and a case of being maintained on a more retarded phase than the intermediate angular phase VTmdl, the former is better than the latter for improving the startability of the internal combustion engine 1.

The hydraulic mechanism 80 includes an oil pump 81 for discharging hydraulic oil stored in the oil pan 13, an oil control valve 82 for controlling modes of supplying and discharging hydraulic oil to/from the phase changing mechanism 30, and an oil switching valve 83 for controlling modes of supplying and discharging hydraulic oil to/from the phase locking mechanism 40. In addition to these components, the hydraulic mechanism 80 includes an oil supply passage 84 for supplying hydraulic oil, discharged from the oil pump 81, to respective parts of the internal combustion engine 1, an oil discharge passage 88 for discharging hydraulic oil in respective parts of the internal combustion engine 1 to the oil pan 13, an phase advancing oil passage 85 and a phase retarding oil passage 86 in relation to the phase changing mechanism 30, and a phase locking oil passage 87 in relation to the phase locking mechanism 40.

The phase advancing oil passage 85 connects a phase advancing chamber 37 in the phase changing mechanism 30 and the oil control valve 82 to each other. The phase retarding oil passage 86 connects a phase retarding chamber 38 in the phase changing mechanism 30 and the oil control valve 82 to each other. The phase locking oil passage 87 connects a first unlocking chamber 54 and a second unlocking chamber 64 in the phase locking mechanism 40 and the oil switching valve 83 to each other.

The controller 90 includes an electronic controller 91 for carrying out various kinds of arithmetic processes and other processes in order to control the internal combustion engine 1, and various kinds of sensors including a crank position sensor 92, a cam position sensor 93, a cooling water temperature sensor 94 and an accelerator position sensor 95.

The crank position sensor 92 outputs a signal corresponding to a rotation angle of the crankshaft 15 (referred to as crank angle CA hereinafter) to the electronic controller 91. The cam position sensor 93 outputs a signal corresponding to a rotation angle of the intake camshaft 22 (referred to as cam angle DA hereinafter) to the electronic controller 91. The cooling water temperature sensor 94 outputs a signal corresponding to the temperature of cooling water in the vicinity of a cooling water outlet in the cylinder head 12 (hereinafter referred to as cooling water temperature TW hereinafter) to the electronic controller 91. The accelerator position sensor 95 outputs a signal corresponding to a depression amount of an accelerator pedal 2 (referred to as accelerator depression amount AP hereinafter), or an accelerator operation amount to the electronic controller 91.

The control performed by the electronic controller 91 will be described. Note that, in the following explanation, a period required from setting a request to start the internal combustion engine 1 to completing an operation to start the internal combustion engine 1 is defined as engine starting period. In addition, a period from setting a request to stop the internal combustion engine 1 to stopping of rotation of the crankshaft 15 is defined as engine stopping transition period. Moreover, a period in which the internal combustion engine 1 is not rotating is defined as engine stopping period. Furthermore, an engine operating period excluding the engine starting period, the engine stopping period and an idle operation period is defined as normal engine operation period.

The electronic controller 91 calculates respective parameters as follows based on an output from each of the sensors:

(A) the electronic controller 91 calculates a calculation value corresponding to the crank angle CA based on an output of the crank position sensor 92;

(B) the electronic controller 91 calculates a calculation value corresponding to a rotational speed of the crankshaft 15 (referred to as engine speed NE hereinafter) based on an calculation value of the crank angle CA;

(C) the electronic controller 91 calculates a calculation value corresponding to the cam angle DA based on an output of the cam position sensor 93;

(D) the electronic controller 91 calculates a calculation value corresponding to the valve timing VT based on the crank angle CA and the cam angle DA;

(E) the electronic controller 91 calculates a calculation value corresponding to the cooling water temperature TW based on an output of the cooling water temperature sensor 94; and (F) the electronic controller 91 calculates a calculation value corresponding to the accelerator depression amount AP based on an output of the accelerator position sensor 95.

The electronic controller 91 performs a valve timing control for controlling the phase changing mechanism 30 and the phase locking mechanism 40 to operate based on an operating state of the engine, and a control selection process at engine starting for selecting a method for advancing the valve timing VT at engine starting. Parameters to define an operating state of the engine include the engine speed NE, an engine load and the like.

The valve timing control includes a phase advancing control for advancing the valve timing VT in the normal engine operation, a phase retarding control for retarding the valve timing VT in the normal engine operation, and a phase holding control for holding the valve timing VT hydraulically in the normal engine operation. The valve timing control also includes a phase locking control for locking the valve timing VT to the intermediate angular phase VTmdl by the phase locking mechanism 40, and a phase unlocking control for unlocking the valve timing VT from the intermediate angular phase VTmdl by the phase locking mechanism 40.

Each of the phase advancing control and the phase retard control sets a target for the valve timing VT (referred to as target angular phase VTtrg hereinafter) based on an operating state of the engine when a request for advancing the valve timing VT (referred to as phase advancing request hereinafter) or a request for retarding the valve timing VT (referred to as phase retarding request hereinafter) is set by a separately executed control.

Then, based on the target angular phase VTtrg and a calculation value of the valve timing VT, the oil control valve 82 is controlled to allow a phase advancing operation or a phase retarding operation of the phase changing mechanism 30.

In the phase holding control, when a request for holding the value timing VT hydraulically in a predetermined phase (referred to as phase holding request hereinafter) is set by a separately executed control, the oil control valve 82 is controlled to allow a hold operation of the phase changing mechanism 30. The phase holding request is set based on, for example, an established idle operation condition. The hold operation refers to an operation performed by the phase changing mechanism 30 in order to hold the valve timing VT in a predetermined phase that falls in a range from the most retarded phase to the most advanced phase.

In the phase locking control, when a request for locking the valve timing VT to the intermediate angular phase VTmdl (referred to as phase locking request hereinafter) is set by a separately executed control, the oil switching valve 83 is controlled in order to allow a lock operation of the phase locking mechanism 40. The phase locking request is set based on an established engine stop condition or an established idle operation condition. The lock operation refers to an operation performed by the phase locking mechanism 40 in order to lock the valve timing VT to the intermediate angular phase VTmdl.

In the phase unlocking control, when a request for unlocking the value timing VT to the intermediate angular phase VTmdl (referred to as phase unlocking request hereinafter) is set by a separately executed control, the oil switching valve 83 is controlled to allow a unlocking operation of the phase locking mechanism 40. The phase unlocking request is set based on a change from the idle operating state to the normal engine operating state, or an increase in the accelerator depression amount AP in the idle operating state. The unlocking operation refers to an operation performed by the phase locking mechanism 40 to unlock the valve timing VT from the intermediate angular phase VTmdl.

Figure 2:
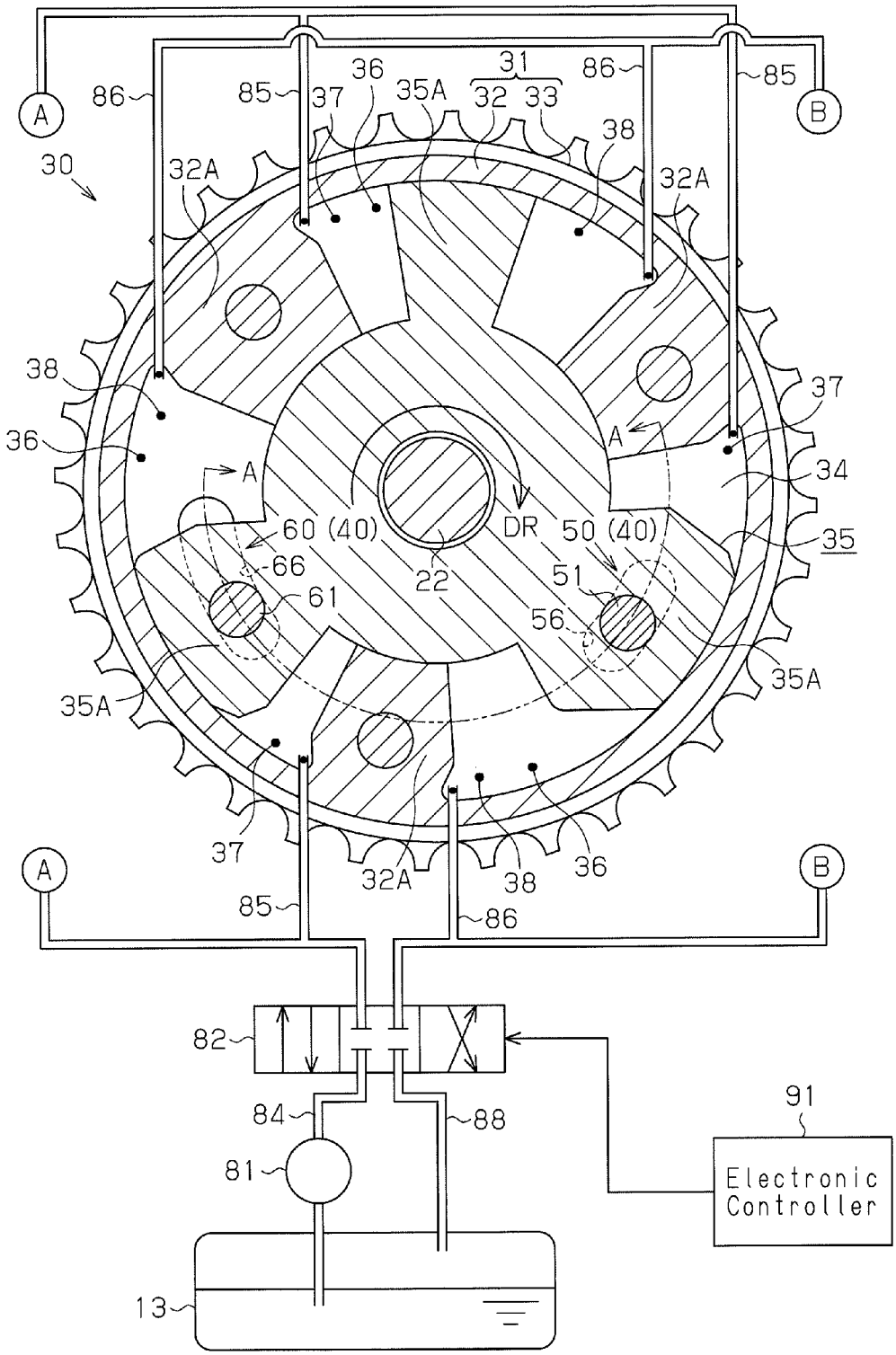
FIG. 2 is a cross-sectional view showing a cross-sectional structure of the variable valve actuation device according to the embodiment.

With reference to FIG. 2, a structure of the phase changing mechanism 30 will be described.

The phase changing mechanism 30 includes a housing rotor 31, which rotates in synchronization with the crankshaft 15 shown in FIG. 1, a vane rotor 35, which rotates in synchronization with the intake camshaft 22, and an assist spring (not shown), which applies force to the vane rotor 35 so that the valve timing VT is advanced.

The valve timing VT is switched in accordance with the rotational phase of the vane rotor 35 relative to the housing rotor 31. Arrow DR in FIG. 2 shows the rotational direction of a sprocket 33 (or the crankshaft 15) and the intake camshaft 22.

The housing rotor 31 includes a housing main body 32 serving as a main body thereof, the sprocket 33, which is fixed to one end of the housing main body 32 in the axial direction, and a cover 34 (see FIG. 3), which is fixed to the other end of the housing main body 32 in the axial direction.

The housing main body 32 includes three partition walls 32A, each of which protrudes in a radial direction of a rotary shaft of the housing rotor 31. The housing main body 32, the sprocket 33 and the cover 34 are fixed to each other by three bolts inserted in the axial direction thereof.

The vane rotor 35 is arranged in a space inside the housing main body 32. It is also fixed to an end portion of the intake camshaft 22. The vane rotor 35 includes three vanes 35A, each of which protrudes toward the housing main body 32.

The phase changing mechanism 30 includes three accommodation chambers 36. Each of the accommodation chambers 36 is formed surrounded by an outer peripheral wall of the housing main body 32, the partition walls 32A arranged side by side, a wall portion of the vane rotor 35, by which the rotary shaft is surrounded, the sprocket 33 and the cover 34. Each of the accommodation chambers 36 accommodates each of the vanes 35A one by one. Each of the accommodation chambers 36 is divided into the phase advancing chamber 37 and the phase retarding chamber 38 by the corresponding vane 35A.

The phase advancing chambers 37 are formed inside the accommodation chambers 36 at a position rearward of the vanes 35A in the rotational direction DR. The phase retarding chambers 38 are formed inside the accommodation chambers 36 at a position frontward of the vanes 35A in the rotational direction DR. The volume of each of the phase advancing chambers 37 and the phase retarding chambers 38 varies depending on the mode of supplying hydraulic oil to the phase changing mechanism 30.

How the phase changing mechanism 30 operates will be described.

When the vane rotor 35 rotates, in response to supply of hydraulic oil to the phase advancing chamber 37 and discharge of hydraulic oil from the phase retarding chamber 38, toward an advanced position relative to the housing rotor 31, or in the rotational direction DR, the valve timing VT is advanced. When the vane rotor 35 rotates to the most advanced position relative to the housing rotor 31, or when the rotational phase of the vane rotor 35 relative to the housing rotor 31 is the most leading rotational phase in the rotational direction DR, the valve timing VT is set to the most advanced phase VTmax.

When the vane rotor 35 rotates, in response to discharge of hydraulic oil from the phase advancing chamber 37 and supply of hydraulic oil to the phase retarding chamber 38, toward a retarded position relative to the housing rotor 31, or in an opposite direction of the rotational direction DR, the valve timing VT is retarded. When the vane rotor 35 rotates to the most retarded position relative to the housing rotor 31, or when the rotational phase of the vane rotor 35 relative to the housing rotor 31 is the most trailing rotational phase in the rotational direction DR, the valve timing VT is set to the most retarded phase VTmin.

With reference to FIG. 2, a structure of the phase locking mechanism 40 will be described.

The phase locking mechanism 40 includes a first locking mechanism 50 for restricting a rotational range of the vane rotor 35 relative to the housing rotor 31, and a second locking mechanism 60 for restricting a rotational range of the vane rotor 35 relative to the housing rotor 31 differently from the first locking mechanism 50. In addition to these mechanisms, the phase locking mechanism 40 includes an opening mechanism 70 (see FIG. 3) for facilitating discharge of hydraulic oil from the phase advancing chamber 37 and the phase retarding chamber 38.

The first locking mechanism 50 and the second locking mechanism 60 are located in different vanes 35A. When the rotational phase of the vane rotor 35 relative to the housing rotor 31 corresponds to the intermediate angular phase VTmdl (referred to as intermediate rotational phase hereinafter), the valve timing VT is locked to the intermediate angular phase VTmdl by cooperation of the first locking mechanism 50 and the second locking mechanism 60.

Figure 3:
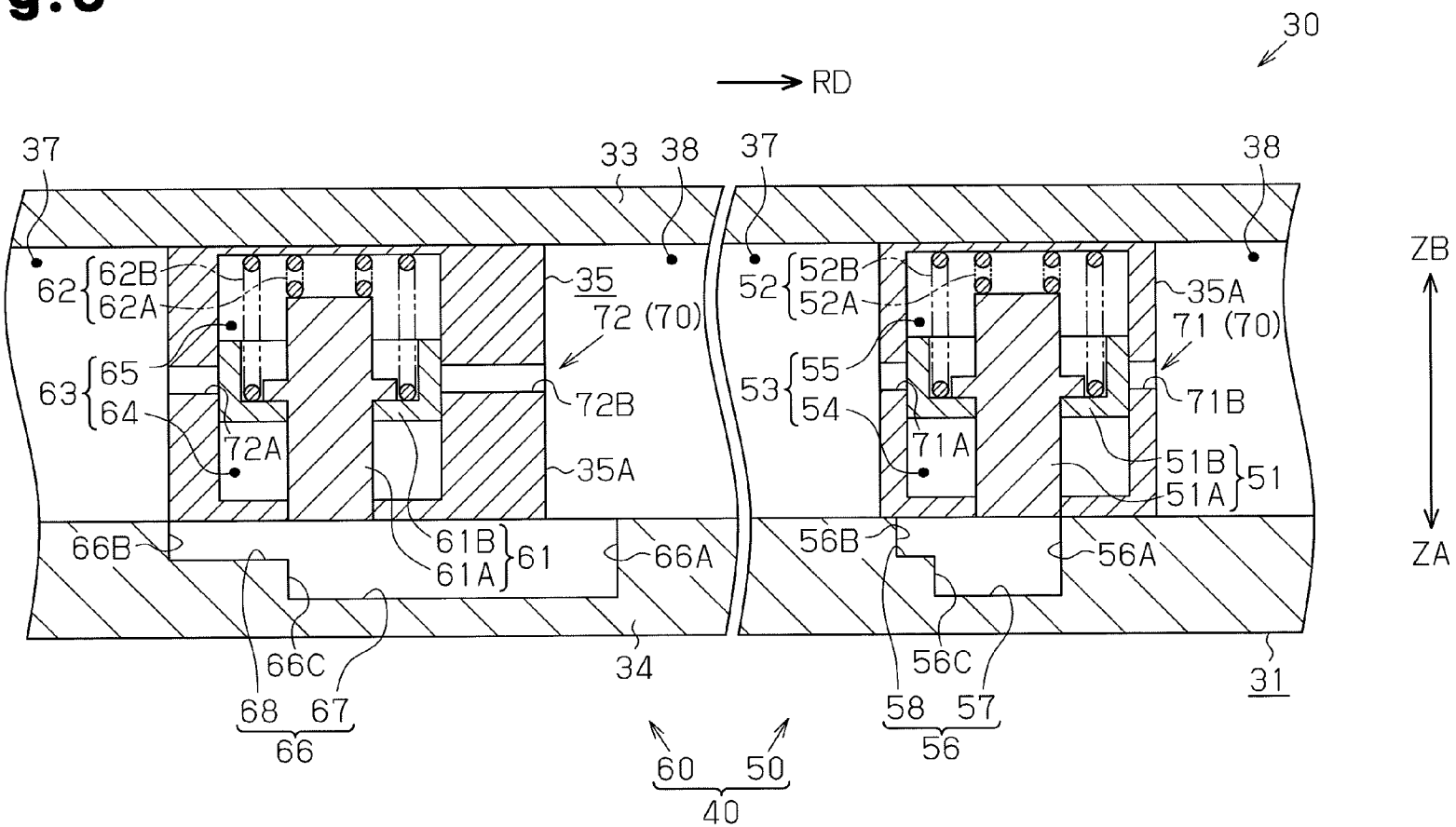
FIG. 3 is a cross-sectional view showing a cross-sectional structure along A-A line of FIG. 2 in the variable valve actuation device according to the embodiment.
Figure 4:
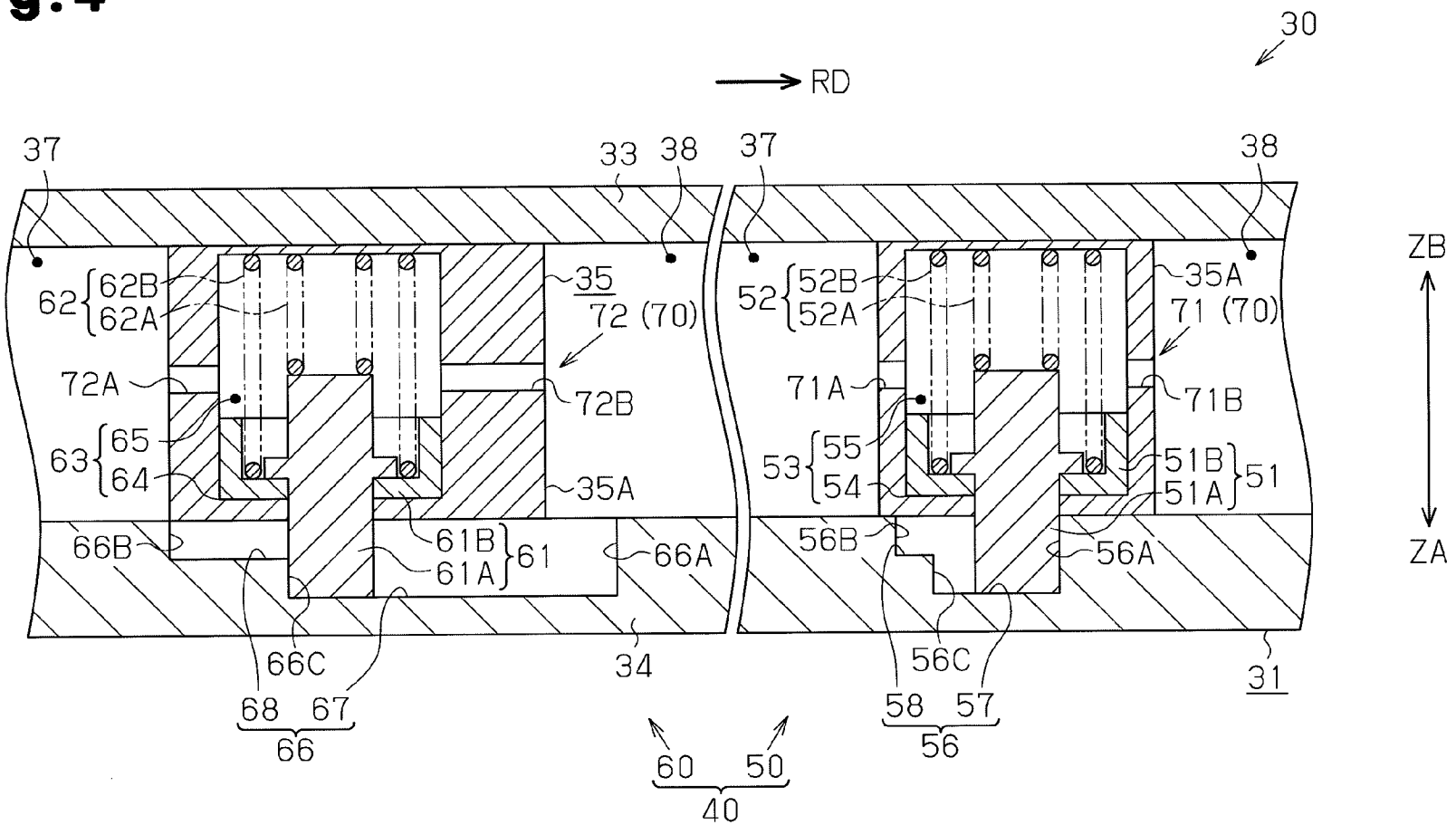
FIG. 4 is a cross-sectional view showing a cross-sectional structure along A-A line of FIG. 2 in the variable valve actuation device according to the embodiment.

With reference to FIGS. 3 and 4, how the first locking mechanism 50 and the second locking mechanism 60 are structured will be described. Each of FIGS. 3 and 4 shows a state in which the rotational phase of the vane rotor 35 is in the intermediate rotational phase relative to the housing rotor 31. Following explanation is based on the assumption that a direction in which a first locking pin 51 of the first locking mechanism 50 and a second locking pin 61 of the second locking mechanism 60 protrude from the vanes 35A is protrusion direction ZA, and a direction in which the first locking pin 51 and the second locking pin 61 move into the vanes 35A is accommodation direction ZB.

The first locking mechanism 50 includes the first locking pin 51, which moves in the axial direction of the vane rotor 35 relative to the vane 35A, a first locking spring 52 for pushing the first locking pin 51 in the protrusion direction ZA, a first lock chamber 53 for accommodating the first locking pin 51 and the first locking spring 52, and a first engagement groove 56 formed to correspond to a circumferential locus of the first locking pin 51.

The first locking pin 51 includes an internal pin 51A, which moves in the protrusion direction ZA and the accommodation direction ZB relative to the vane 35A and protrudes to the outside of the vane 35A, and an external pin 51B, which moves inside the vane 35A in the protrusion direction ZA and the accommodation direction ZB relative to the vane 35A.

The first locking spring 52 includes an internal spring 52A for pushing the internal pin 51A in the protrusion direction ZA, and an external spring 52B for pushing the external pin 51B in the protrusion direction ZA.

The first lock chamber 53 is formed inside the vane 35A. It is also divided by the first locking pin 51 into the first unlocking chamber 54 and a first spring chamber 55. On the assumption that no hydraulic oil flows via clearances of respective components that constitute the first locking mechanism 50, no flow of hydraulic oil is formed between the first unlocking chamber 54 and the first spring chamber 55.

The first engagement groove 56 consists of two grooves each of which has a mutually different depth, or more specifically includes a first lower groove 57, which is relatively deep, and a first upper groove 58, which is relatively shallow. The first upper groove 58 is formed on a more retarded position than the first lower groove 57 in the circumferential direction of the housing rotor 31.

A first advanced end portion 56A, which is the advanced end of the first lower groove 57, is formed at a position corresponding to an advancing end surface of the internal pin 51A of the first locking pin 51 in the vane rotor 35 under the intermediate rotational phase. A first retarded end portion 56B, which is a retarded end of the first upper groove 58 is formed on a more retarded position than the first advanced end portion 56A in the circumferential direction of the housing rotor 31. A second retarded end portion 56C, which is the retarded end of the first lower groove 57, is formed between the first advanced end portion 56A and the first retarded end portion 56B in the circumferential direction of the housing rotor 31.

The second locking mechanism 60 includes the second locking pin 61, which moves in the axial direction of the vane rotor 35 relative to the vane 35A, a second locking spring 62 for pushing the second locking pin 61 in the protrusion direction ZA, a second lock chamber 63 for accommodating the second locking pin 61 and the second locking spring 62, and a second engagement groove 66 formed to correspond to a circumferential locus of the second locking pin 61.

The second locking pin 61 includes an internal pin 61A, which moves in the protrusion direction ZA and the accommodation direction ZB relative to the vane 35A and protrudes to the outside of the vane 35A, and an external pin 61B, which moves inside the vane 35A in the protrusion direction ZA and the accommodation direction ZB relative to the vane 35A.

The second locking spring 62 includes an internal spring 62A for pushing the internal pin 61A in the protrusion direction ZA, and an external spring 62B for pushing the external pin 61B in the protrusion direction ZA.

The second lock chamber 63 is formed inside the vane 35A. It is also divided by the second locking pin 61 into the second unlocking chamber 64 and a second spring chamber 65. On the assumption that no hydraulic oil flows via clearances of respective components that constitute the second locking mechanism 60, no flow of hydraulic oil is formed between the second unlocking chamber 64 and the second spring chamber 65.

The second engagement groove 66 consists of two grooves having different depths, or more specifically includes a second lower groove 67, which is relatively deep, and a second upper groove 68, which is relatively shallow. The second upper groove 68 is formed on the retarded side of the second lower groove 67 in the circumferential direction of the housing rotor 31. The first locking pin 51, the first engagement groove 56, the second locking pin 61 and the second engagement groove 66 correspond to independent phase advancing mechanism.

A fourth retarded end portion 66C, which is the retarded-end of the second lower groove 67, is formed at a position corresponding to a retarding end surface of the internal pin 61A of the second locking pin 61 in the vane rotor 35 under the intermediate rotational phase. A third retarded end portion 66B, which is a retarding end potion of the second upper groove 68, is formed on the retarded side of the fourth retarded end portion 66C in the circumferential direction of the housing rotor 31. A second advanced end portion 66A, which is the advanced end of the second lower groove 67 is formed on the advanced side of the fourth retarded end portion 66C in the circumferential direction of the housing rotor 31.

With reference to FIGS. 3 and 4, how the phase locking mechanism 40 operates will be described.

The internal pin 51A of the first locking pin 51 moves in the axial direction relative to the vane 35A in a range from a position at which the tip end thereof is brought into contact with a bottom surface of the first lower groove 57 of the first engagement groove 56 (referred to as protruded position of the first locking pin 51 hereinafter) to a position at which the tip end thereof is accommodated inside the vane 35A (referred to as accommodated position of the first locking pin 51 hereinafter). The position of the internal pin 51A relative to the vane 35A varies depending on the relationship between an acting force based on oil pressure of the first unlocking chamber 54 and an elastic force of the first locking spring 52.

If the first locking pin 51 is located at a position corresponding to the first lower groove 57 in the circumferential direction of the housing rotor 31, the external pin 51B of the first locking pin 51 moves in the axial direction in conjunction with the internal pin 51A. In contrast, if the first locking pin 51 is located at a position that does not correspond to the first lower groove 57 in the circumferential direction of the housing rotor 31, the external pin 51B is allowed to move in the axial direction independently from the internal pin 51A in accordance with the relationship between an acting force based on oil pressure of the first unlocking chamber 54 and an elastic force of the first locking spring 52.

In the following explanation, a position to which the external pin 51B moves inside the vane 35A at the maximum in the protrusion direction ZA is defined as opening position of the external pin 51B. Also, a position to which the external pin 51B moves inside the vane 35A at the maximum in the accommodation direction ZB is defined as closing position of the external pin 51B.

The internal pin 61A of the second locking pin 61 moves in the axial direction relative to the vane 35A in a range from a position at which the tip end thereof is brought into contact with a bottom surface of the second lower groove 67 of the second engagement groove 66 (referred to as protruded position of the second locking pin 61 hereinafter) to a position at which the tip end thereof is accommodated inside the vane 35A (referred to as accommodated position of the second locking pin 61 hereinafter). The position of the internal pin 61A relative to the vane 35A varies depending on the relationship between an acting force based on oil pressure of the second unlocking chamber 64 and an elastic force of the second locking spring 62.

If the second locking pin 61 is located at a position corresponding to the second lower groove 67 in the circumferential direction of the housing rotor 31, the external pin 61B of the second locking pin 61 moves in the axial direction in conjunction with the internal pin 61A. In contrast, if the second locking pin 61 is located at a position that does not correspond to the second lower groove 67 in the circumferential direction of the housing rotor 31, the external pin 61B is allowed to move in the axial direction independently from the internal pin 61A in accordance with the relationship between an acting force based on oil pressure of the second unlocking chamber 64 and an elastic force of the second locking spring 62.

In the following explanation, a position to which the external pin 61B moves inside the vane 35A at the maximum in the protrusion direction ZA is defined as opening position of the external pin 61B. Also, a position to which the external pin 61B moves inside the vane 35A at the maximum in the accommodation direction ZB is defined as closing position of the external pin 61B.

Operating states of the phase locking mechanism 40 are defined.

A state of the phase locking mechanism 40 when it operates when the first locking pin 51 and the second locking pin 61 are located at the accommodated position, is defined as phase unlocking state of the phase locking mechanism 40. In addition, a state of the phase locking mechanism 40 when it operates when the first locking pin 51 and the second locking pin 61 are located at the protruded position is defined as phase locking state of the phase locking mechanism 40. FIG. 3 shows an example of the phase unlocking state of the phase locking mechanism 40. FIG. 4 shows the phase locking state of the phase locking mechanism 40.

How the first locking pin 51 operates will be described. Since the second locking pin 61 operates according to the following operation of the first locking pin 51, explanation on how the second locking pin 61 operates is omitted.

If a force that acts on the first locking pin 51 based on oil pressure of the first unlocking chamber 54 is smaller than an elastic force of the first locking spring 52, a force is given to the first locking pin 51 so as to move the first locking pin 51 in the protrusion direction ZA. Then, if the first locking pin 51 is located in a place corresponding to the first lower groove 57 in the circumferential direction of the housing rotor 31, if the first locking pin 51 is located at the accommodated position in the axial direction of the housing rotor 31 and if a force acts on the first locking pin 51 so as to move the first locking pin 51 in the protrusion direction ZA, the internal pin 51A moves from the accommodated position as shown in FIG. 3 to the protruded position as shown in FIG. 4. In conjunction with the movement of the internal pin 51A, the external pin 51B also moves from the closing position to the opening position.

If a force that acts on the first locking pin 51 based on oil pressure of the first unlocking chamber 54 is greater than an elastic force of the first locking spring 52, a force is given to the first locking pin 51 so as to move the first locking pin 51 in the accommodation direction ZB. Then, if the first locking pin 51 is located at the protruded position in the axial direction of the housing rotor 31, and if a force acts on the first locking pin 51 so as to move the first locking pin 51 in the accommodation direction ZB, the internal pin 51A moves from the protruded position as shown in FIG. 4 to the accommodated position as shown in FIG. 3. In conjunction with the movement of the internal pin 51A, the external pin 51B also moves from the opening position to the closing position.

When the first locking pin 51 is located at the protruded position, the vane rotor 35 is inhibited from rotating in the phase advancing direction beyond the intermediate rotational phase relative to the housing rotor 31. Also, when the second locking pin 61 is located at the protruded position, the vane rotor 35 is inhibited from rotating in the phase retarding direction beyond the intermediate rotational phase relative to the housing rotor 31.

It is therefore not possible, when the first locking pin 51 and the second locking pin 61 are located at the protruded position, for the vane rotor 35 to rotate from the intermediate rotational phase in the phase advancing direction or the phase retarding direction relative to the housing rotor 31. In other words, the valve timing VT is locked to the intermediate angular phase VTmdl.

How the phase changing mechanism 30 operates at engine starting will be described.

At the normal start of the engine, hydraulic oil stored in the phase advancing chamber 37 and the phase retarding chamber 38 of the phase changing mechanism 30 is sufficiently less than that in the normal engine operation. A state with sufficiently less hydraulic oil means a state in which the amount of hydraulic oil is reduced to the extent that an appropriate control of the valve timing VT by oil pressure of the phase changing mechanism 30 is difficult.

As a result, the advance rate of the valve timing VT due to torque variations in the intake camshaft 22 (referred to as intake cam torque variation hereinafter) becomes greater than that in the normal engine operation. Then, even if it is difficult to control the valve timing VT by oil pressure of the phase changing mechanism 30 at engine starting, the valve timing VT can be locked to the intermediate angular phase VTmdl by the phase locking mechanism 40 by using an advance of the valve timing VT due to the intake cam torque variation. In the following explanation, an advancing operation of the valve timing VT due to the intake cam torque variation is defined as independent advance.

How the phase locking mechanism 40 operates in response to the independent advance of the phase changing mechanism 30 is as shown below.

If the engine starts operating in a state with sufficiently less hydraulic oil stored in the phase advancing chamber 37 and the phase retarding chamber 38 of the phase changing mechanism 30, the intake cam torque variation causes the vane rotor 35 to rotate from a rotational phase corresponding to the most retarded phase VTmin to an advanced position. Then, owing to operations of the first locking pin 51 and the second locking pin 61 in the following order of A) to D), the valve timing VT is locked to the intermediate angular phase VTmdl.

(A) In accordance with rotation of the vane rotor 35 to an advanced position, when the first locking pin 51 reaches a position corresponding to the first upper groove 58 in the circumferential direction, the first locking pin 51 protrudes to the first upper groove 58.

(B) In the above (A) state, in accordance with rotation of the vane rotor 35 to an advanced position, when the second locking pin 61 reaches a position corresponding to the second upper groove 68 in the circumferential direction, the second locking pin 61 protrudes to the second upper groove 68.

(C) In the above (B) state, in accordance with rotation of the vane rotor 35 to an advanced position, when the second locking pin 61 reaches a position corresponding to the second lower groove 67 in the circumferential direction, the second locking pin 61 protrudes to the second lower groove 67. In other words, the second locking pin 61 is located at the protruded position.

(D) In the above (C) state, in accordance with rotation of the vane rotor 35 to an advanced position, when the first locking pin 51 reaches a position corresponding to the first lower groove 57 in the circumferential direction, the first locking pin 51 protrudes to the first lower groove 57. In other words, the first locking pin 51 is located at the protruded position.

In the above (D) state, the first locking pin 51 and the second locking pin 61 are located at the protruded position, which therefore prevents rotation of the vane rotor 35 from the intermediate rotational phase in a phase advancing direction or a phase retarding direction relative to the housing rotor 31. That is, the valve timing VT is locked to the intermediate angular phase VTmdl.

With reference to FIG. 3, how the opening mechanism 70 is structured will be described.

The opening mechanism 70 includes a first opening mechanism 71, which allows the phase advancing chamber 37 and the phase retarding chamber 38 to communicate with each other via the first spring chamber 55 of the vane 35A provided with the first locking mechanism 50, and a second opening mechanism 72, which allows the phase advancing chamber 37 and the phase retarding chamber 38 to communicate with each other via the second spring chamber 65 of the vane 35A provided with the second locking mechanism 60.

The first opening mechanism 71 includes a phase advancing chamber opening passage 71A, which allows the first spring chamber 55 and the phase advancing chamber 37 to communicate with each other, a phase retarding chamber opening passage 71B, which allows the first spring chamber 55 and the phase retarding chamber 38 to communicate with each other, and the external pin 51B of the first locking mechanism 50.

The second opening mechanism 72 includes a phase advancing chamber opening passage 72A, which allows the second spring chamber 65 and the phase advancing chamber 37 to communicate with each other, a phase retarding chamber opening passage 72B, which allows the second spring chamber 65 and the phase retarding chamber 38 to communicate with each other, and the external pin 61B of the second locking mechanism 60.

Figure 5A:
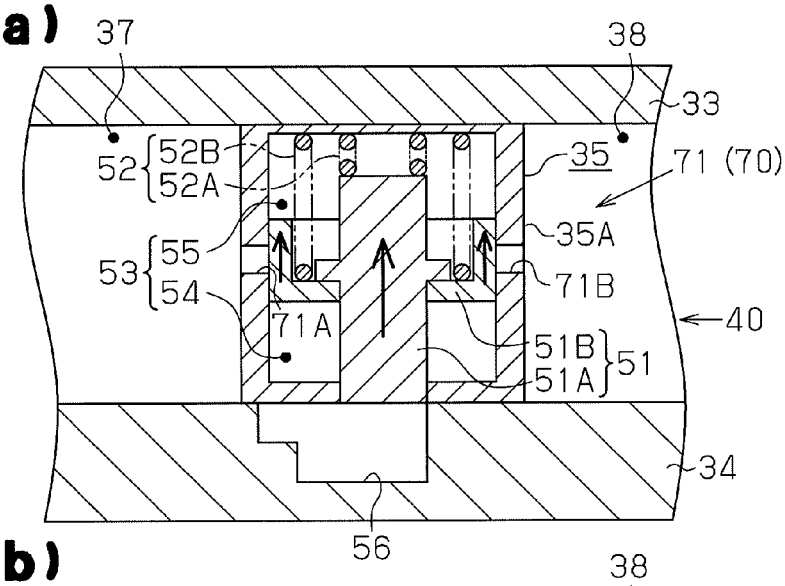
FIG. 5 is a cross-sectional view showing a cross-sectional structure of a first locking mechanism of FIG. 3 and the vicinity thereof in the variable valve actuation device according to the embodiment.
Figure 5B:
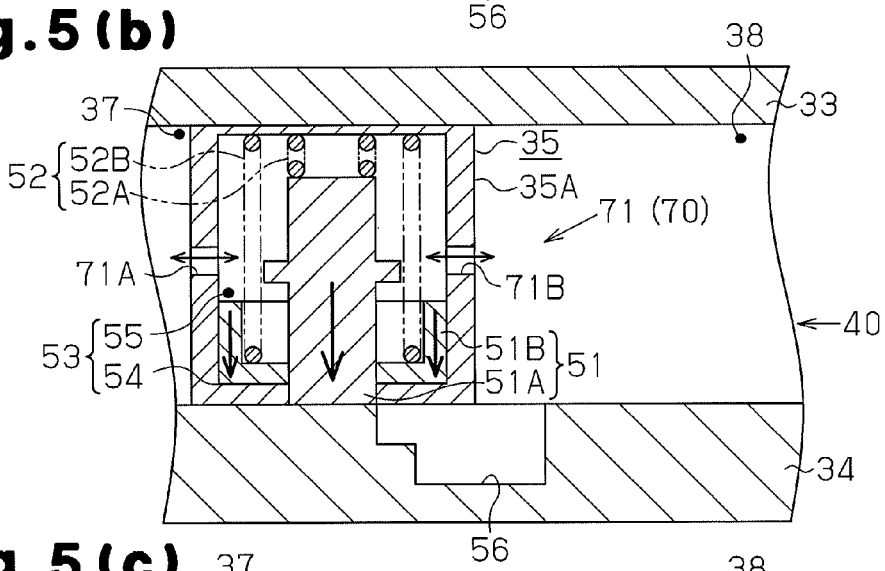
Figure 5C:
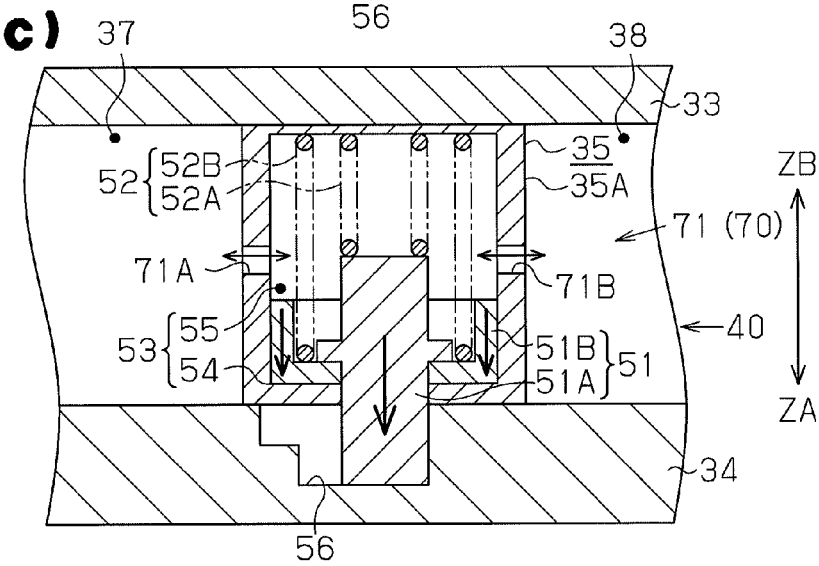

With reference to FIG. 5, how the first opening mechanism 71 operates will be described. Since the second opening mechanism 72 operates according to the following operation of the first opening mechanism 71, explanation on how the second opening mechanism 72 operates is omitted.

As shown in FIG. 5(*a*), in the phase unlocked state of the phase locking mechanism 40, if the first locking pin 51 is located in a place corresponding to the first lower groove 57 in the circumferential direction of the housing rotor 31, and if a force acts on the first locking pin 51 so as to move the first locking pin 51 in the accommodation direction ZB, the external pin 51B is located at the closing position. Therefore, the phase advancing chamber opening passage 71A and the phase retarding chamber opening passage 71B are closed by the external pin 51B. That is, the first spring chamber 55, the phase advancing chamber 37 and the phase retarding chamber 38 are blocked off from each other.

As shown in FIG. 5(*b*), in the phase unlocked state of the phase locking mechanism 40, if the first locking pin 51 is located in a place which does not correspond to the first lower groove 57 in the circumferential direction of the housing rotor 31, and if a force acts on the first locking pin 51 so as to move the first locking pin 51 in the protrusion direction ZA, the external pin 51B is located at the opening position. Therefore, the phase advancing chamber opening passage 71A and the phase retarding chamber opening passage 71B are released from the external pin 51B. That is, the first spring chamber 55, the phase advancing chamber 37 and the phase retarding chamber 38 communicate with each other. As an example of an operating state of the engine in which the phase locking mechanism 40 and the opening mechanism 70 operate as shown in FIG. 5(*b*), there is such a case that the phase locking mechanism 40 operates in the phase unlocked state at engine starting.

As shown in FIG. 5(*c*), in a phase locking state of the phase locking mechanism 40, if a force acts on the first locking pin 51 so as to move the first locking pin 51 in the protrusion direction ZA, the external pin 51B is located at the opening position. Therefore, the phase advancing chamber opening passage 71A and the phase retarding chamber opening passage 71B are released from the external pin 51B. That is, the first spring chamber 55, the phase advancing chamber 37 and the phase retarding chamber 38 communicate with each other.

If the first spring chamber 55, the phase advancing chamber 37 and the phase retarding chamber 38 communicate with each other, and if hydraulic oil is supplied to one of the phase advancing chamber 37 and the phase retarding chamber 38 via the oil control valve 82, this hydraulic oil is also supplied to the other one of the phase advancing chamber 37 and the phase retarding chamber 38 via the first spring chamber 55. As a result, in comparison with a case with no communication between the phase advancing chamber 37 and the phase retarding chamber 38, a greater amount of hydraulic oil is supplied to the other one of the phase advancing chamber 37 and the phase retarding chamber 38.

With reference to FIG. 2, control of the oil control valve 82 will be described.

The oil control valve 82 includes a phase advancing port for connecting the phase advancing oil passage 85 and the oil supply passage 84 or the oil discharge passage 88 to each other, and a phase retarding port for connecting the phase retarding oil passage 86 and the oil supply passage 84 and the oil discharge passage 88 to each other. The relationship of connection of the phase advancing oil passage 85 and the phase retarding oil passage 86 relative to the oil supply passage 84 and the oil discharge passage 88 as well as the passage area of the phase advancing port and the phase retarding port vary depending on the duty cycle, which corresponds to a command signal output from the electronic controller 91.

The electronic controller 91 switches an operating state of the oil control valve 82 (referred to as OCV operation mode hereinafter) by changing the duty cycle output to an actuator of the oil control valve 82. Prepared in advance as the OCV operation mode selected by the electronic controller 91 are a phase advancing mode, a phase retarding mode and a phase holding mode. Then, by switching the OCV operation mode, the relationship of connection of the phase advancing oil passage 85 and the phase retarding oil passage 86 relative to the oil supply passage 84 and the oil discharge passage 88 as well as the passage area of the phase advancing port and the phase retarding port are switched.

The relationship between the OCV operation mode and the duty cycle will be described.

The oil control valve 82 has, as an operation area corresponding to the duty cycle, a phase retarding zone, a dead zone, and a phase advancing zone.

The phase retarding zone ranges from the minimum duty cycle to a predetermined first duty cycle in a duty cycle variable area. The oil control valve 82 connects the phase advancing oil passage 85 and the oil discharge passage 88 to each other as well as the phase retarding oil passage 86 and the oil supply passage 84 to each other in response to an output of a duty cycle that falls in the phase retarding zone.

The dead zone ranges from the predetermined first duty cycle to a predetermined second duty cycle. The oil control valve 82 cuts off the phase advancing oil passage 85 and the phase retarding oil passage 86 relative to the oil supply passage 84 and the oil discharge passage 88 in response to an output of a duty cycle that falls in the dead zone.

The phase advancing zone ranges from the predetermined second duty cycle to the maximum duty cycle obtained in a duty cycle variable area. The oil control valve 82 connects the phase advancing oil passage 85 and the oil supply passage 84 to each other as well as the phase retarding oil passage 86 and the oil discharge passage 88 to each other in response to an output of a duty cycle that falls in the phase advancing zone.

The electronic controller 91 outputs duty cycles as follows in accordance with the OCV operation mode.

(A) When the phase holding mode is selected as the OCV operation mode, a duty cycle included in the dead zone is output to an actuator of the oil control valve 82. At this time, the phase advancing chamber 37 and the phase retarding chamber 38 are closed to the oil control valve 82. The rotational phase of the vane rotor 35 relative to the housing rotor 31 is therefore held by oil pressures of the phase advancing chamber 37 and the phase retarding chamber 38.

(B) When the phase retarding mode is selected as the OCV operation mode, a duty cycle included in the phase advancing zone is output to an actuator of the oil control valve 82. At this time, hydraulic oil is discharged from the phase advancing chamber 37 and hydraulic oil is supplied to the phase retarding chamber 38. A force is therefore given to the vane rotor 35 so as to allow rotation of the vane rotor 35 in a phase retarding direction relative to the housing rotor 31.

(C) When the phase advancing mode is selected as the OCV operation mode, a duty cycle included in the phase advancing zone is output to an actuator of the oil control valve 82. At this time, hydraulic oil is supplied to the phase advancing chamber 37 and hydraulic oil is discharged from the phase retarding chamber 38. A force is therefore given to the vane rotor 35 so as to allow rotation of the vane rotor 35 in a phase advancing direction relative to the housing rotor 31.

The flow rate of hydraulic oil in the phase advancing oil passage 85 and the phase retarding oil passage 86 will be described.

The flow rate of hydraulic oil in the phase advancing oil passage 85 increases as the passage area of the phase advancing port becomes greater. The phase advancing port is also accompanied by a greater passage area as the magnitude of a duty cycle included in the phase advancing zone approaches the maximum duty cycle or as the magnitude of a duty cycle included in the phase retarding zone approaches the minimum duty cycle.

The flow rate of hydraulic oil in the phase retarding oil passage 86 increases as the passage area of the phase retarding port becomes larger. The phase retarding port is also accompanied by a larger passage area as the magnitude of a duty cycle included in the phase retarding zone approaches the minimum duty cycle or as the magnitude of a duty cycle included in the phase advancing zone approaches the maximum duty cycle.

The electronic controller 91 changes the magnitude of a duty cycle included in the phase advancing zone if it is necessary to change the amount of hydraulic oil supplied to the phase advancing chamber 37 in the phase advancing mode. It also changes the magnitude of a duty cycle included in the phase retarding zone if it is necessary to change the amount of hydraulic oil supplied to the phase retarding chamber 38 in the phase retarding mode.

Then, in response to an increased duty cycle in the phase advancing mode, an increased amount of hydraulic oil is supplied to the phase advancing chamber 37 and an increased amount of hydraulic oil is discharged from the phase retarding chamber 38. Also in response to an increased duty cycle in the phase retarding mode, an increased amount of hydraulic oil is supplied to the phase retarding chamber 38 and an increased amount of hydraulic oil is discharged from the phase advancing chamber 37.

With reference to FIGS. 3 and 4, control of the oil switching valve 83 will be described.

The electronic controller 91 shown in FIG. 1 switches an operating state of the oil switching valve 83 (referred to as OSV operation mode hereinafter) by switching a command signal sent to an actuator of the oil switching valve 83.

The relationship between each of the OSV operation modes and an operation of the phase locking mechanism 40 is as shown below.

(A) In the phase locking mode set as the OSV operation mode, hydraulic oil is discharged from the first unlocking chamber 54 and the second unlocking chamber 64. Therefore, a projecting force acts on the first locking pin 51 and the second locking pin 61.

(B) In the phase unlocking mode set as the OSV operation mode, hydraulic oil is supplied to the first unlocking chamber 54 and the second unlocking chamber 64. Therefore, an accommodating force acts on the first locking pin 51 and the second locking pin 61.

The valve timing control will be described.

The electronic controller 91 shown in FIG. 1 controls, in the valve timing control, the oil control valve 82 and the oil switching valve 83 in accordance with an operating state of the engine as shown in (A) to (F) below.

(A) In the normal engine operation, for the phase advancing control carried out in accordance with an operating state of the engine, the phase advancing mode is selected as the OCV operation mode. The phase unlocking mode is also selected as the OSV operation mode.

(B) In the normal engine operation, for the phase retard control carried out in accordance with an operating state of the engine, the phase retarding mode is selected as the OCV operation mode. The phase unlocking mode is also selected as the OSV operation mode.

(C) In the normal engine operation, for the phase holding control carried out in accordance with an operating state of the engine, the phase holding mode is selected as the OCV operation mode. The phase unlocking mode is also selected as the OSV operation mode. If the absolute value of the difference between an average value of the valve timing VT and the target angular phase VTtrg thereof is greater than or equal to a predetermined value due to variations of the valve timing VT, a feedback control is carried out to make the average value closer to the target angular phase VTtrg.

(D) In the normal engine operation, for the phase locking control carried out in response to the phase locking request, the OSV operation mode is switched from the phase unlocking mode to the phase locking mode. The OCV operation mode is also selected in order to switch the valve timing VT to the intermediate angular phase VTmdl.

(E) At the starting of the engine or in the idle operation thereof, for the phase unlocking control carried out in response to the phase unlocking request, the OSV operation mode is switched from the phase locking mode to the phase unlocking mode. Also, in response to any of the phase advancing request, the phase retarding request and the phase holding request, any of the phase advancing mode, the phase retarding mode and the phase holding mode is selected as the OCV operation mode.

(F) When the starting of the engine is initiated, if the phase locking mechanism 40 operates in the phase locking state, and without an established phase unlocking condition at engine starting, it is prohibited to switch the operating state of the phase locking mechanism 40 based on the phase advancing request, the phase retarding request and the phase holding request. This control is carried out prior to the above D) control.

Figure 8:
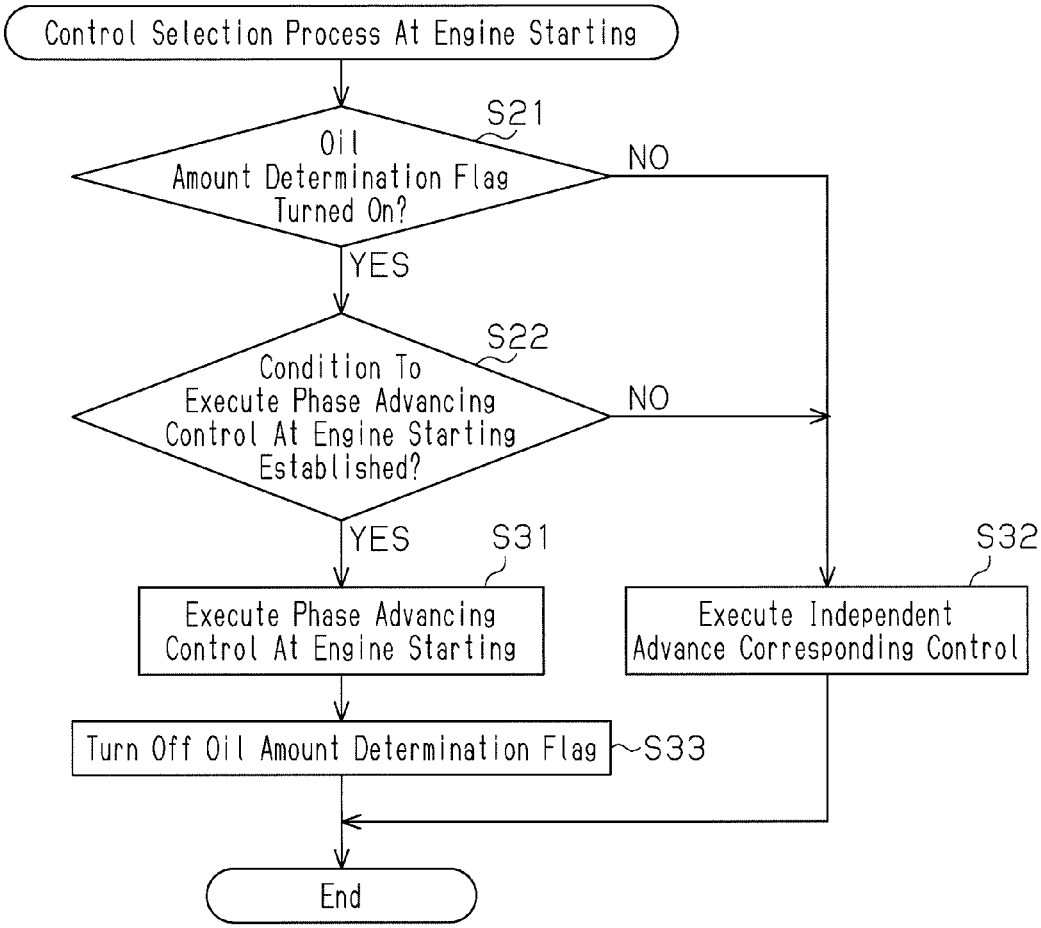
FIG. 8 is a flowchart showing a procedure of a control selection process at engine starting, which is carried out by the controller for the variable valve actuation device according to the embodiment.

(G) When the starting of the engine is initiated, if the phase locking mechanism 40 operates in the phase unlocked state, and if an independent advance corresponding control is selected by the control selection process at engine starting as shown in FIG. 8, the phase advancing mode is selected as the OCV operation mode. The phase locking mode is also selected as the OSV operation mode.

(H) When the starting of the engine is initiated, if the phase locking mechanism 40 operates in the phase unlocking state, and if a phase advancing control at engine starting is selected by the control selection process at engine starting as shown in FIG. 8, the phase advancing mode is selected as the OCV operation mode. The phase unlocking mode is also selected as the OSV operation mode. Then, when the valve timing VT reaches the intermediate angular phase VTmdl, the OCV operation mode is switched from the phase advancing mode to the phase holding mode.

The phase unlocking condition at engine starting used in the above (F) control will be described.

The phase unlocking condition at engine starting is set as a condition to determine that the valve timing VT is less likely to be in an unstable state even if the phase locking mechanism 40 is switched to operate in the phase unlocked state at the starting of the engine. An unstable state of the valve timing VT refers to a state with large variations of the valve timing VT resulting from insufficiently filled hydraulic oil in the phase advancing chamber 37 and the phase retarding chamber 38.

The independent advance corresponding control in the above (G) will be described.

At the normal start of the engine, due to sufficiently reduced hydraulic oil in the phase changing mechanism 30, oil pressure that makes it possible to move the vane rotor 35 in the phase changing mechanism 30 is not given to the vane rotor 35. Therefore, irrespective to the OCV operation mode, the vane rotor 35 is advanced or retarded in accordance with cam torque variation.

Also, because of sufficiently reduced hydraulic oil in the phase locking mechanism 40, oil pressure that makes it possible to move the first locking pin 51 and the second locking pin 61 in the phase locking mechanism 40 is not given to each of the pins 51 and 61. Therefore, irrespective to the OSV operation mode, a force acts on the first locking pin 51 and the second locking pin 61 in the phase locking mechanism 40 so as to move each of the pins 51 and 61 to the protruded position.

As stated above, without controlling the OCV operation mode and the OSV operation mode at engine starting, the valve timing VT is locked to the intermediate angular phase VTmdl by the independent advance. However, since the amount of hydraulic oil remaining in the phase changing mechanism 30 and the phase locking mechanism 40 at the initiation of the starting of the engine vary depending on circumstances in a range from the last stopping of the engine to the initiation of the starting of the engine, no control of the OCV operation mode and the OSV operation mode may result in causing the following problems. A state with no control of the OCV operation mode and the OSV operation mode refers to a state in which no control is made to switch an operation mode depending on a result of determination of whether or not a predetermined condition, which is predefined in accordance with an operating state of the engine or other factors, is established.

For example, if no control of the OCV operation mode at engine starting is followed by maintaining the phase retarding mode as the OCV operation mode selected at the last stopping of the engine, and if a large amount of hydraulic oil is stored in the phase retarding chamber 38 at the initiation of the starting of the engine, hydraulic oil in the phase retarding chamber 38 is less likely to be discharged. Resistance to an advance of the valve timing VT due to the intake cam torque variation becomes greater and therefore prevents the independent advance.

Also, if no control of the OSV operation mode at engine starting is followed by maintaining the phase unlocking mode as the OSV operation mode selected at the last stopping of the engine, and if a large amount of hydraulic oil is stored in at least one of the first unlocking chamber 54 and the second unlocking chamber 64 at the initiation of the starting of the engine, at least one of the first locking pin 51 and the second locking pin 61 does not move to the protruded position. Therefore, even if the vane rotor 35 is advanced to the intermediate rotational phase due to the intake cam torque variation, the valve timing VT is not locked to the intermediate angular phase VTmdl.

Therefore, according to the independent advance corresponding control, in order to lock the valve timing VT to the intermediate angular phase VTmdl by the independent advance more frequently at engine starting, the phase advancing mode is selected as the OCV operation mode and the phase locking mode is selected as the OSV operation mode.

The phase advancing control at engine starting in the above (H) will be described.

At the starting of the engine, if the phase changing mechanism 30 contains a required amount of hydraulic oil to control the valve timing VT by oil pressure of the phase changing mechanism 30, the valve timing VT can be advanced hydraulically. Accordingly, if the valve timing VT needs to be advanced hydraulically at the starting of the engine, the phase advancing control at engine starting is carried out.

According to the phase advancing control at engine starting, based on the absolute value of the difference between the valve timing VT and the intermediate angular phase VTmdl (referred to as phase difference VTD hereinafter), a feedback control is carried out to make the average value closer to the target angular phase VTtrg. In other words, the duty cycle of the oil control valve 82 is controlled based on the phase difference VTD. To be more specific, the duty cycle of the oil control valve 82 is controlled so that a greater amount of hydraulic oil is supplied to the phase advancing chamber 37 as the phase difference VTD increases, or as the amount of hydraulic oil remaining in the phase retarding chamber 38 (referred to as residual oil amount Q hereinafter) increases.

The electronic controller 91 controls the duty cycle of the oil control valve 82 so that the amount of hydraulic oil supplied to the phase advancing chamber 37 in the phase advancing control at engine starting is greater than the amount of hydraulic oil supplied to the phase advancing chamber 37 in the independent advance corresponding control. Therefore, a force to advance the valve timing VT by oil pressure of the phase advancing chamber 37 in the phase advancing control at engine starting is greater than a force to advance the valve timing VT by the oil control valve 82 in the independent phase advancing control. Accordingly, even if a large amount of hydraulic oil is stored in the phase retarding chamber 38 at the initiation of the starting of the engine, the valve timing VT is switched to the intermediate angular phase VTmdl promptly by the phase advancing control at engine starting.

With reference to FIG. 1, the control selection process at engine starting will be described.

As one of indicators for evaluating the startability of the internal combustion engine 1, an engine starting period is suggested. Then, in order to satisfy the startability required in the internal combustion engine 1, it is necessary to start the internal combustion engine 1 so that an actual engine starting period under various kinds of start environments is less than or equal to a required starting period.

Meanwhile, as a main factor of influencing the engine starting period, the valve timing VT at the starting of the engine is considered. Therefore, in the internal combustion engine 1, with intention to complete the start within the required starting period, the phase locking control is performed so that the valve timing VT is locked to the intermediate angular phase VTmdl at the starting of the engine.

The intermediate angular phase VTmdl is, even under low-temperature environments in which the combustibility of a air-fuel mixture decreases significantly, adaptable to the valve timing VT by which the starting of the engine can be completed within the required starting period. The low-temperature environments refer to environments in which the outdoor air temperature is below the freezing point.

According to the phase locking control, in order to lock the valve timing VT to the intermediate angular phase VTmdl in the engine stopping transition period, the OCV operation mode and the OSV operation mode are controlled based on the phase locking request, which is set in accordance with a condition to stop the engine.

Then, when the valve timing VT is locked to the intermediate angular phase VTmdl at the last engine stopping transition, or when the valve timing VT is locked to the intermediate angular phase VTmdl at the current initiation of the starting of the engine, the start of the internal combustion engine 1 is completed within the required starting period even under the low-temperature environments.

In contrast, even if the valve timing VT is not locked to the intermediate angular phase VTmdl at the initiation of the starting of the engine, by locking the valve timing VT to the intermediate angular phase VTmdl after the initiation of the starting of the engine, the start of the internal combustion engine 1 can be completed within the required starting period under the low-temperature environments.

However, in this case, a period required from the initiation of the starting of the engine to lock the valve timing VT to the intermediate angular phase VTmdl (referred to as lock period hereinafter) needs to be within a required lock period. In other words, even if the valve timing VT is locked to the intermediate angular phase VTmdl after the initiation of the starting of the engine, a lock period that exceeds the required lock period is accompanied by a high likelihood that the engine starting period exceeds the required starting period. This tendency is particularly remarkable under the low-temperature environments.

Therefore, if the valve timing VT is not locked to the intermediate angular phase VTmdl at the initiation of the starting of the engine, the electronic controller 91 performs the control selection process at engine starting as a process to select a method for advancing the valve timing VT in order to lock the valve timing VT to the intermediate angular phase VTmdl within the required lock period.

The resistance force to an advance of the valve timing VT due to the intake cam torque variation at engine starting varies under the influence of the residual oil amount Q. As a result, an advance speed of the valve timing VT in the phase advance control (referred to as hydraulic advance speed hereinafter) and an advance speed of the valve timing VT due to the intake cam torque variation (referred to as independent advance speed hereinafter) are related as follows depending on the residual oil amount Q at engine starting.

That is, in response to a residual oil amount Q that is sufficiently less at engine starting, the independent advance speed exceeds the hydraulic advance speed more frequently. In contrast, in response to a residual oil amount Q that is large at the starting of the engine, the hydraulic advance speed exceeds the independent advance speed more frequently.

Then, according to the control selection process at engine starting, a method for advancing the valve timing VT at the start point of the engine is selected based on the above relationship between the hydraulic advance speed and the independent advance speed. More specifically, the residual oil amount Q obtained at a point of time at which the internal combustion engine 1 begins a start operation, or the residual oil amount Q at engine starting is compared to a reference oil amount QA that is preset as a determined value, and if the residual oil amount Q is greater than or equal to the reference oil amount QA, the valve timing VT is advanced by the phase advancing control at engine starting. In contrast, if the residual oil amount Q is less than the reference oil amount QA, the valve timing VT is advanced by the independent advance. At this time, for controlling the variable valve actuation device 20, the independent advance corresponding control is performed. The reference oil amount QA corresponds to reference value.

Figure 6:
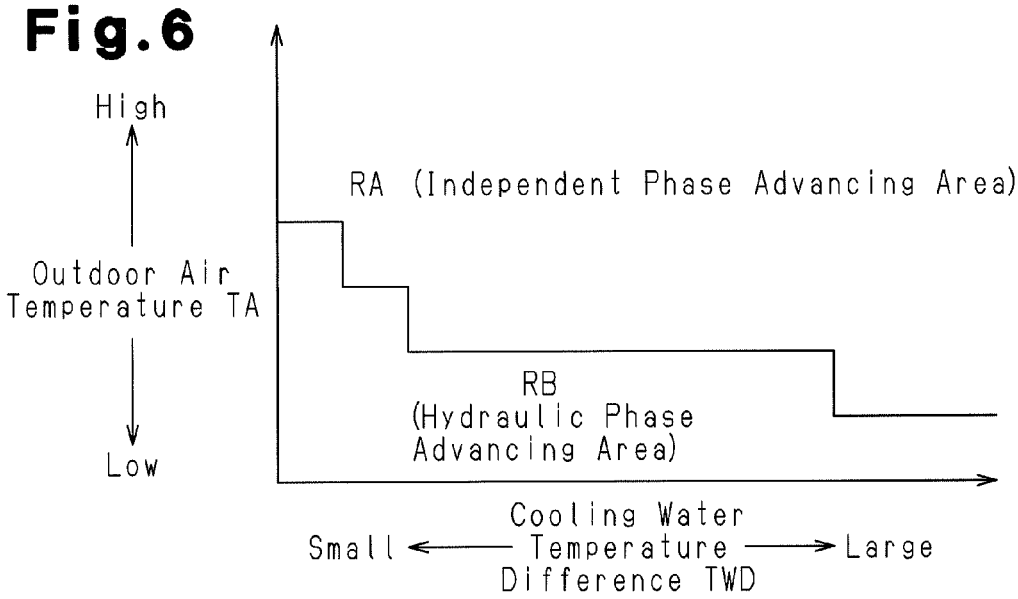
FIG. 6 is a map showing an area subjected to an independent advance and an area subjected to an oil pressure control based on the relationship between a cooling water temperature difference and an outdoor air temperature in the variable valve actuation device according to the embodiment.

With reference to FIG. 6, a concrete procedure of selecting a phase advancing method will be described.

The residual oil amount Q at engine starting can be calculated as the difference between the residual oil amount Q at a point of time at which the last stopping of the engine is completed (referred to as residual oil amount Q at the last engine stopping hereinafter) and the amount of hydraulic oil flowing out from the phase retarding chamber 38 to the outside in the engine stopping period, or in a period from the completion of the last engine stopping to the current initiation of the starting of the engine (referred to as outflow at engine stopping hereinafter). The outflow at engine stopping can also be calculated as the product of an outflow speed of hydraulic oil stored in the phase retarding chamber 38 from a clearance of the phase changing mechanism 30 to the outside in the engine stopping period (referred to as outflow speed at engine stopping hereinafter) and a length of the engine stopping period. Note that, as the outflow speed at engine stopping, a speed which represents an outflow speed of hydraulic oil in the engine stopping period can be used.

Accordingly, in the control selection process at engine starting, by using the absolute value of the difference between the cooling water temperature TW at engine stopping and the cooling water temperature TW at engine starting (referred to as cooling water temperature difference TWD hereinafter) as an indicator of the engine stopping period, and by using an outdoor air temperature TA at engine starting as an indicator of the outflow speed at engine stopping, how these indicators are related to a method for advancing the valve timing at engine starting is defined in a control area map shown in FIG. 6. The cooling water temperature TW at engine stopping particularly refers to the cooling water temperature TW at the point of completion of the engine stopping. Also, the cooling water temperature TW at engine starting particularly refers to the cooling water temperature TW at the point of the initiation of the starting of the engine. Furthermore, the outdoor air temperature TA at engine starting particularly refers to the outdoor air temperature TA at the point of the initiation of the starting of the engine.

The degree of reduction of the cooling water temperature TW in the engine stopping period increases as the engine stopping period becomes longer. Therefore, a change on the control area map in a direction in which the cooling water temperature difference TWD increases means that the engine stopping period becomes longer.

The outflow speed at engine stopping increases as the viscosity of hydraulic oil becomes lower in the engine stopping period. The viscosity of hydraulic oil in the engine stopping period is also correlated to the temperature of hydraulic oil in the engine stopping period. The temperature of hydraulic oil in the engine stopping period is also correlated to the cooling water temperature TW in the engine stopping period. The cooling water temperature TW in the engine stopping period is also correlated to the cooling water temperature TW at the current start of the engine. The cooling water temperature TW at the current start of the engine is also correlated to the outdoor air temperature TA at the current start of the engine. Therefore, a change on the control area map in a direction in which the outdoor air temperature TA increases indicates that the outflow speed at engine stopping becomes higher.

The control area map is divided into, based on the relationship between the engine stopping period and the cooling water temperature difference TWD as well as the relationship between the outflow speed at engine stopping and the outdoor air temperature TA as stated above, an area in which the residual oil amount Q at engine starting is estimated to be less than the reference oil amount QA (referred to as independent phase advancing area RA hereinafter), and an area in which the residual oil amount Q at engine starting is estimated to be the reference oil amount QA or more (referred to as hydraulic phase advancing area RB hereinafter).

The independent phase advancing area RA is, based on an indication by the cooling water temperature difference TWD and the outdoor air temperature TA that the residual oil amount Q is less than the reference oil amount QA, set as an area in which the independent advance is predetermined as a method for advancing the valve timing VT at engine starting.

The hydraulic phase advancing area RB is, based on an indication by the cooling water temperature difference TWD and the outdoor air temperature TA that the residual oil amount Q is greater than or equal to the reference oil amount QA, set as an area in which the phase advance control is predetermined as a method for advancing the valve timing VT at engine starting.

Then, in the control selection process at engine starting, it is determined whether the cooling water temperature difference TWD and the outdoor air temperature TA at engine starting belong to either the independent phase advancing area RA or the hydraulic phase advancing area RB. If the cooling water temperature difference TWD and the outdoor air temperature TA belong to the independent phase advancing area RA, the independent advance is selected as a method for advancing the valve timing VT. At this time, the phase advancing control at engine starting is also carried out to control the phase changing mechanism 30. In contrast, if the cooling water temperature difference TWD and the outdoor air temperature TA belong to the hydraulic phase advancing area RB, the phase advance control is selected as a method for advancing the valve timing VT.

The electronic controller 91 has, in selecting a method for advancing the valve timing at engine starting, separately from the control selection process at engine starting using the above control area map, a stopping transition control designating process (FIG. 7) to select a phase advancing method in accordance with the residual oil amount Q at engine stopping.

In a period from completing the last stopping of the engine to beginning of the current start of the engine, there is basically no increase in the amount of hydraulic oil stored in the phase retarding chamber 38. Therefore, if the residual oil amount Q is less than the reference oil amount Q at the last engine stopping, the residual oil amount Q at the current start of the engine is also estimated to be less than the reference oil amount QA. Meanwhile, a variation width of the valve timing VT in the engine stopping transition (referred to as phase variation width FW hereinafter) varies in accordance with the residual oil amount Q in the phase retarding chamber 38 at engine stopping.

From the above description, if the residual oil amount Q at the last stopping of the engine, which is estimated based on the phase variation width FW, is less than the reference oil amount QA, it is possible to designate the independent advance as a method for advancing the valve timing VT with no estimation of the residual oil amount Q at the current start of the engine. The phase variation width FW can be calculated as the absolute value of the difference between a maximum value and a minimum value of the valve timing VT in a period in which the crank angle CA varies with a predetermined amount.

Accordingly, in the stopping transition control designating process, if the residual oil amount Q at engine stopping is indicated to be less than the reference oil amount QA by the phase variation width FW at engine stopping, a history showing it is stored. Then, if the history is checked at the current start of the engine, the independent advance is selected as a method for advancing the valve timing VT. The selection of a phase advancing method based on the above history is performed prior to the selection of a phase advancing method using the control area map.

Figure 7:
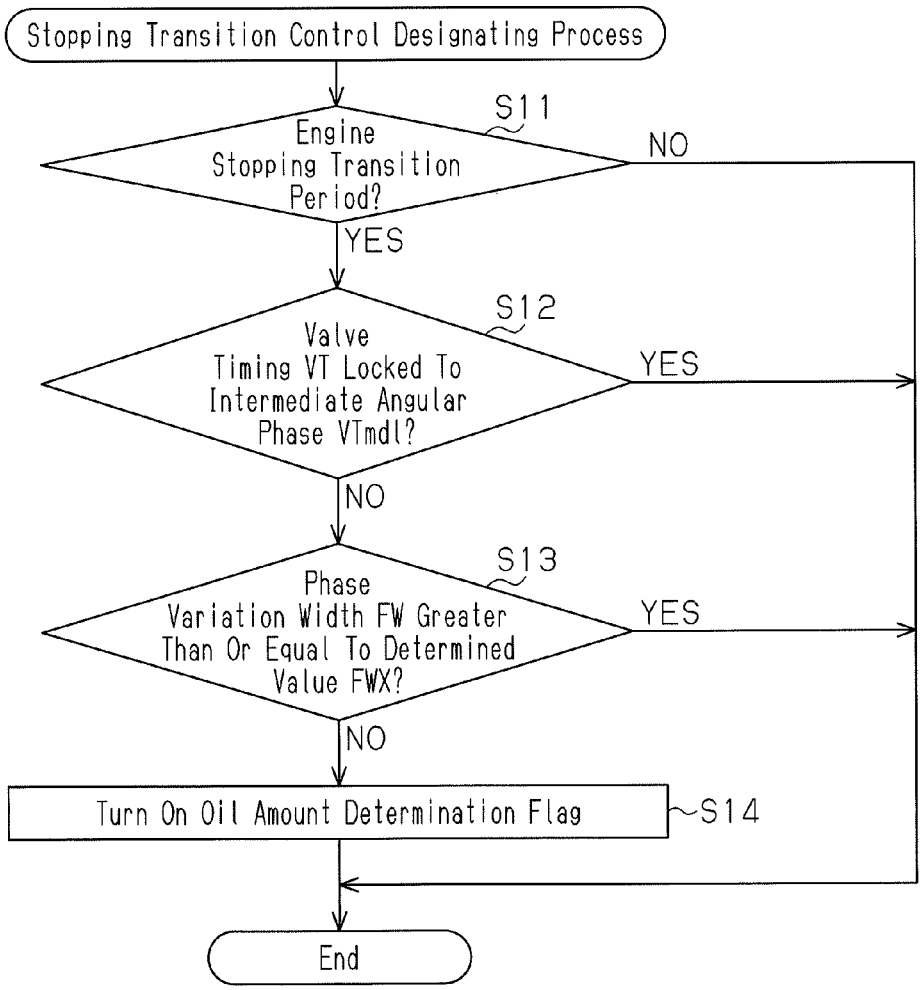
FIG. 7 is a flowchart showing a procedure of a engine stopping transition control designating process, which is carried out by a controller for the variable valve actuation device according to the embodiment.

With reference to FIG. 7, a procedure of the stopping transition control designating process will be described.

In Step S11, whether or not it is currently in the engine stopping transition period is determined. Based on the stopping of combustion of a air-fuel mixture in response to an engine stop request accompanied by operating an ignition switch, it is determined to be currently in the engine stopping transition period.

If it is determined to be currently in the engine stopping transition period in Step S11, it is followed by Step S12 to determine whether or not the valve timing VT is locked to the intermediate angular phase VTmdl by the phase locking mechanism 40, or more specifically whether or not the phase locking mechanism 40 operates in the phase locking state.

Based on a state of the valve timing VT, which is continuously held in the intermediate angular phase VTmdl over a predetermined period or longer, the valve timing VT is determined to be locked to the intermediate angular phase VTmdl.

If it is determined in Step S12 that the valve timing VT is not locked to the intermediate angular phase VTmdl, it is followed by Step S13 to determine whether or not the phase variation width FW is greater than or equal to a determined value FWX.

If the phase variation width FW is determined to be the determined value FWX or more in Step S13, the residual oil amount Q is estimated to be less than the reference oil amount QA at engine stopping. It is therefore possible to estimate the residual oil amount Q as less than the reference oil amount QA at engine starting. In contrast, if the phase variation width FW is determined to be less than the determined value FWX in Step S13, the residual oil amount Q is estimated to be the reference oil amount QA or more at engine stopping. Then, it is followed by Step S14 in which an oil amount determination flag is set be turned on. The oil amount determination flag corresponds to history at engine stopping.

With reference to FIG. 8, a procedure of the control selection process at engine starting will be described.

In Step S21, it is determined whether or not the oil amount determination flag is turned on. If it is determined in Step S21 that the oil amount determination flag is turned off, or if there is a history showing that the residual oil amount Q is less than the reference oil amount QA at the last stopping of the engine, the process will move onto Step S32. In contrast, if it is determined in Step S21 that the oil amount determination flag is turned on, or if a possibility remains such that the residual oil amount Q may be greater than or equal to the reference oil amount QA at the current initiation of the starting of the engine because of an existing history showing that the residual oil amount Q is greater than or equal to the reference oil amount QA at the last stopping of the engine, the process will move onto Step S22.

In Step S22, based on the cooling water temperature difference TWD and the outdoor air temperature TA, it is determined whether or not a condition to execute the phase advancing control at engine starting is established, or more specifically, whether or not the residual oil amount Q is greater than or equal to the reference oil amount QA.

If the cooling water temperature difference TWD and the outdoor air temperature TA belong to the hydraulic phase advancing area in the control area map shown in FIG. 6, a condition to execute the phase advancing control at engine starting is determined to be established.

If it is determined negative in Step S21, or if it is determined negative in Step S22, it is followed by Step S32 to perform the independent advance corresponding control. That is, the phase advancing mode is selected as the OCV operation mode and the phase locking mode is selected as the OSV operation mode.

If it is determined positive in Step S22, it is followed by Step S31 to perform the phase advancing control at engine starting. That is, the phase advancing mode is selected as the OCV operation mode and the phase unlocking mode is selected as the OSV operation mode. In addition, when the valve timing VT reaches the intermediate angular phase VTmdl, the OSV operation mode is switched from the phase advancing mode to the phase holding mode. Then, in Step S33, the oil amount determination flag is turned off.

Advantages of the Embodiment

The internal combustion engine 1 according to the present embodiment achieves the following advantages.

1) In the internal combustion engine 1, if the phase locking mechanism 40 operates in the phase unlocked state, and if the residual oil amount Q is greater than or equal to the reference oil amount QA at engine starting, the valve timing VT is advanced by oil pressure of the phase changing mechanism 30. Owing to this structure, it is possible to suppress reduction of the startability of the internal combustion engine 1 due to hydraulic oil remaining in the phase retarding chamber 38.

(2) In addition, in comparison with a structure in which the valve timing VT is advanced by the independent advance even if the residual oil amount Q is greater than or equal to the reference oil amount QA at engine starting, an advance speed of the valve timing VT is accelerated when the residual oil amount Q is greater than or equal to the reference oil amount QA.

Therefore, in comparison with the above comparative structure, even if an assist spring is set to have a smaller restoring force, the startability of the internal combustion engine 1 is less likely to decrease. Also, by using an assist spring whose restoring force is small, low resistance is applied to the assist spring when the valve timing VT is retarded in the normal engine operation. Therefore, a loss associated with driving the oil pump 81 is reduced.

(3) In the internal combustion engine 1, in response to the residual oil amount Q which is less than the reference oil amount QA at engine starting, and in response to the valve timing VT which is advanced up to the intermediate angular phase VTmdl, the valve timing VT is locked to the intermediate angular phase VTmdl by the phase locking mechanism 40. Owing to this structure, in comparison with a structure in which the valve timing VT is not locked by the phase locking mechanism 40 at engine starting, the phase variation width FW becomes smaller.

(4) In the internal combustion engine 1, if the phase locking mechanism 40 operates in the phase unlocked state and the residual oil amount Q is greater than or equal to the reference oil amount QA at engine starting, the valve timing VT is held in the intermediate angular phase VTmdl by oil pressure of the phase changing mechanism 30. Owing to this structure, in comparison with a structure in which the valve timing VT is held in a more retarded phase than the intermediate angular phase VTmdl at engine starting, the startability of the internal combustion engine 1 is enhanced.

(5) In the internal combustion engine 1, if the oil amount determination flag which shows that the phase variation width FW is greater than or equal to a determined value at the last stopping of the engine is set, or if the residual oil amount Q is estimated to be less than the reference oil amount QA at the current start of the engine, the valve timing VT is advanced by the independent advance at engine starting. Owing to this structure, in comparison with a hypothetical structure in which the valve timing VT is advanced by oil pressure of the phase changing mechanism 30 at engine starting with a setting of the oil amount determination flag, the valve timing VT is switched to the intermediate angular phase VTmdl at an early stage more frequently.

Other Embodiments

The present invention is not limited to the above embodiment and, for example, can be modified as follows. Each of following modified examples is not only applied exclusively to the above embodiment but also allowed to be executed in combination with another modified example.

In the above embodiment, based on the comparison between the residual oil amount Q and the reference oil amount QA at engine starting, either the phase advancing control at engine starting or the independent advance corresponding control is selected for execution at engine starting, but a condition to select a control executed at engine starting can be modified as follows. That is, by assuming that the pressure of hydraulic oil that remains in the phase retarding chamber 38 as residual oil pressure P, it is possible to select a control that is executed at engine starting based on a result of the comparison between the residual oil pressure P and a reference oil pressure PA that serves as a determined value. In this case, concrete examples of what is included in the control are as shown below. The reference oil pressure PA is preset based on a result of a test or other factors and corresponds to reference value.

(A) In place of the selection of a control based on a result of the comparison between the residual oil amount Q and the reference oil amount QA at engine starting, a control to be executed at engine starting is selected in accordance with a result of the comparison between the residual oil pressure P and the reference oil pressure PA. The control in this case corresponds to a control in the above embodiment where the residual oil amount Q is replaced with the residual oil pressure P.

(B) In accordance with a result of the comparison between the residual oil amount Q and the reference oil amount QA at engine starting, and in accordance with a result of the comparison between the residual oil pressure P and the reference oil pressure PA at engine starting, a control to be executed at engine starting is selected. According to the control in this case, the phase advancing control at engine starting is selected if at least one of the comparison between the residual oil amount Q and the reference oil amount QA and the comparison between the residual oil pressure P and the reference oil pressure PA indicates that the residual oil amount Q is large at engine starting. Alternatively, the phase advancing control at engine starting is selected if both the comparison between the residual oil amount Q and the reference oil amount QA and the comparison between the residual oil pressure P and the reference oil pressure PA indicate that the residual oil amount Q is large at engine starting.

In the above modified examples of (A) and (B), it is possible to set an oil pressure determination flag corresponding to the oil amount determination flag if the phase variation width FW is greater than or equal to a predetermined determined value in the engine stopping transition period.

In the above modified examples of (A) and (B), it is also possible to calculate the residual oil pressure P at engine starting based on at least one of the residual oil amount Q and the residual oil pressure P at the last stopping of the engine as well as the outflow at engine stopping.

In the above embodiment, it is also possible to calculate the residual oil amount Q at engine starting based on the residual oil amount Q and the residual oil pressure P at the last stopping of the engine as well as the outflow at engine stopping, or based on the residual oil pressure P at the last stopping of the engine as well as the outflow at engine stopping.

In the stopping transition control designating process of the above embodiment (see FIG. 7), upon determination in Step S13 of the process that the residual oil amount Q is less than the reference oil amount QA at engine stopping, the independent advance is selected as a method for advancing the valve timing VT at engine starting. However, how to select a phase advancing method can be modified as follows. That is, a phase advancing method can be selected according to a result of the comparison between the engine stopping period and a determined period. To be more specific, if the engine stopping period is greater than or equal to the determined period, or if the residual oil amount Q is estimated to be less than the reference oil amount QA at engine starting due to leakage of hydraulic oil in the engine stopping period, the independent advance is selected as a method for advancing the valve timing VT. In contrast, if the engine stopping period is less than the determined period, or if the residual oil amount Q is estimated to be the reference oil amount QA or more at the initiation of the starting of the engine, a method for advancing the valve timing VT is selected based on the control area map. Note that, if this selection method is employed, the process in Step S13 of the stopping transition control designating process is omitted.

In the control area map according to the above embodiment (see FIG. 6), the control areas are defined by the cooling water temperature difference TWD and the outdoor air temperature TA, wherein the cooling water temperature TW at engine starting can be used in place of the outdoor air temperature TA. Because the cooling water temperature TW at engine starting serves as an indicator of the temperature of hydraulic oil in the engine stopping period in the same manner as the outdoor air temperature TA, even if the cooling water temperature TW is used and adapted to the map in place of the outdoor air temperature TA, it is possible to obtain advantageous effects similar to those of the above embodiment.

In the stopping transition control designating process according to the above embodiment (see FIG. 7), the contents of the determination process in Step S12 can be modified as follows. That is, whether or not the valve timing VT is locked to the intermediate angular phase VTmdl is determined based on a result of the comparison between the phase variation width FW at engine stopping and a determination value at engine stopping. To be more specific, if the phase variation width FW is less than or equal to the determination value at engine stopping, the valve timing VT is determined to be locked to the intermediate angular phase VTmdl. In contrast, if the phase variation width FW is greater than a determination value at engine stopping, it is determined that the valve timing VT is not locked to the intermediate angular phase VTmdl. The determination value at engine stopping is preset based on a test or other factors as a value to determine that the valve timing VT is locked to the intermediate angular phase VTmdl.

In the control selection process at engine starting according to the above embodiment (see FIG. 8), the contents of the determination process in Step S22 can be modified as follows. That is, whether or not the residual oil amount Q is greater than or equal to the reference oil amount QA is determined based on a result of the comparison between the phase variation width FW at engine starting and a determination value at engine starting. To be more specific, if the phase variation width FW at engine starting is greater than or equal to the determination value at engine starting, the residual oil amount Q is determined to be the reference oil amount QA or more. In contrast, if the phase variation width FW at engine starting is less than the determination value at engine starting, the residual oil amount Q is determined to be less than the reference oil amount QA. The determination value at engine starting is preset based on a test or other factors as a value to determine that the residual oil amount Q at engine starting is greater than or equal to the reference oil amount QA.

In Step S31 of the control selection process at engine starting according to the above embodiment (see FIG. 8), the valve timing VT is held in the intermediate angular phase VTmdl by oil pressure of the phase changing mechanism 30, wherein the valve timing VT can also be held within a predetermined range that is more advanced than the most retarded phase VTmin and includes the intermediate angular phase VTmdl.

In Step S31 of the control selection process at engine starting according to the above embodiment (see FIG. 8), when the valve timing VT reaches the intermediate angular phase VTmdl in accordance with an advance of the valve timing VT by oil pressure of the phase changing mechanism 30, the valve timing VT is held hydraulically, wherein the valve timing VT can also be locked to the intermediate angular phase VTmdl by the phase locking mechanism 40.

In the above embodiment, an assist spring can be omitted in the variable valve actuation device 20.

In the above embodiment (see FIG. 1), a single oil control valve can be used in place of the oil control valve 82 and the oil switching valve 83 in order to control forms of supplying and discharging hydraulic oil to/from the phase advancing chamber 37, the phase retarding chamber 38 and each of the unlocking chambers 54 and 64.

In the above embodiment (see FIG. 3), in place of the first lower groove 57 of the first locking mechanism 50, a hole into which the first locking pin 51 is fitted can be formed at a position corresponding to the intermediate rotational phase. In this case, the end of the first upper groove 58 is extended to the hole. Also, in place of the second lower groove 67 of the second locking mechanism 60, a hole into which the second locking pin 61 is fitted can be formed at a position corresponding to the intermediate rotational phase.

In the above embodiment (see FIG. 3), it is also possible to form at least one of the first engagement groove 56 and the second engagement groove 66 in the vane rotor 35 and arrange at least one of the first locking pin 51 and the second locking pin 61 in the housing rotor 31.

In the above embodiment (FIG. 3), the external pin 51B, the external spring 52B and the first opening mechanism 71 can be omitted in the first locking mechanism 50. The external pin 61B, the external spring 62B and the second opening mechanism 72 can also be omitted in the second locking mechanism 60.

In the above embodiment (see FIG. 3), as at least one of the first locking pin 51 and the second locking pin 61, an element that performs a protruding operation and an accommodating operation in the circumferential direction relative to the vanes 35A can also be used. In this case, corresponding to an operational change of the first locking pin 51 and the second locking pin 61 relative to the vanes 35A, at least one of engagement grooves corresponding to the first engagement groove 56 and the second engagement groove 66 is formed in the housing rotor 31.

In the above embodiment (see FIG. 3), at least one of the first locking mechanism 50 and the second locking mechanism 60 can be omitted. In this case, because of the necessity of locking the valve timing VT to the intermediate angular phase VTmdl by one locking mechanism, the first locking mechanism 50 or the second locking mechanism 60 provided in the variable valve actuation device 20 has, in place of the first engagement groove 56 and the second engagement groove 66, a hole into which the first locking pin 51 or the second locking pin 61 is fitted.

In the above embodiment (see FIG. 4), in place of the intermediate angular phase VTmdl to which the valve timing VT is locked by the phase locking mechanism 40, another valve timing VT can also be employed. Another valve timing VT can be selected from any valve timings VT falling in a range in which the valve timing VT can be locked within a required lock period, and from any valve timing VT falling in a range between the most retarded phase VTmin and the intermediate angular phase VTmdl, or from any valve timings VT more advanced than the intermediate angular phase VTmdl.

The structure of the variable valve actuation device which is subjected to application of the present invention is not limited to the exemplified structure of the above embodiment. More specifically, as long as the phase changing mechanism and the phase locking mechanism are provided in a variable valve actuation device, any variable valve actuation devices with other structures can be used to apply the present invention. Even in this case, advantageous effects according to those of the above embodiment can be obtained.

EXPLANATION OF NUMERALS

1 Internal combustion engine
2 Accelerator pedal
10 Engine main body
11 Cylinder block
12 Cylinder head
13 Oil pan
14 Combustion chamber
15 Crankshaft
20 Variable valve actuation device
21 Intake valve
22 Intake camshaft
23 Exhaust valve
24 Exhaust camshaft
30 Phase changing mechanism
31 Housing rotor
32 Housing main body
32A Partition wall
33 Sprocket
34 Cover
35 Vane rotor
35A Vane
36 Accommodation chamber
37 Phase advancing chamber
38 Phase retarding chamber
40 Phase locking mechanism
50 First locking mechanism
51 First locking pin (independent phase advancing mechanism)
51A Internal pin
51B External pin
52 First locking spring
52A Internal spring
52B External spring
53 First lock chamber
54 First unlocking chamber
55 First spring chamber
56 First engagement groove (independent phase advancing mechanism)
56A First advanced end portion
56B First retarded end portion
56C Second retarded end portion
57 First lower groove
58 First upper groove
60 Second locking mechanism
61 Second locking pin (independent phase advancing mechanism)
61A Internal pin
61B External pin
62 Second locking spring
62A Internal spring
62B External spring
63 Second lock chamber
64 Second unlocking chamber
65 Second spring chamber
66 Second engagement groove (independent phase advancing mechanism)
66A Second advanced end portion
66B Third retarded end portion
66C Fourth retarded end portion
67 Second lower groove
68 Second upper groove
70 opening mechanism

71 First opening mechanism
71A Phase advancing chamber opening passage
71B Phase retarding chamber opening passage
72 Second opening mechanism
72A Advance chamber opening passage
72B Retard chamber opening passage
80 Hydraulic mechanism
81 Oil pump
82 Oil control valve
83 Oil switching valve
84 Oil supply passage
85 Phase advancing oil passage
86 Phase retarding oil passage
87 Phase locking oil passage
88 Oil discharge passage
90 Controller
91 Electronic controller
92 Crank position sensor
93 Cam position sensor
94 Cooling water temperature sensor
95 Accelerator position sensor

The invention claimed is:

1. A controller for a variable valve actuation device, the variable valve actuation device comprising:

a hydraulic phase changing mechanism for changing valve timing of an internal combustion engine by selectively supplying and discharging hydraulic oil to and from an phase advancing chamber and a phase retarding chamber;

a phase locking mechanism for locking the valve timing to a specific angular phase that is more advanced than the most retarded phase; and an independent phase advancing mechanism for advancing the valve timing in accordance with cam torque variations from the most retarded phase to the specific angular phase, wherein the amount of hydraulic oil remaining in the phase retarding chamber is defined as a residual oil amount and the pressure of hydraulic oil remaining in the phase retarding chamber is defined as a residual oil pressure, and the controller allows a greater amount of hydraulic oil to be supplied to the phase advancing chamber when the residual oil amount or the residual oil pressure is large at engine starting in comparison with a case in which the residual oil amount or the residual oil pressure is small at engine starting.

2. The controller for a variable valve actuation device according to claim 1, wherein the controller increases the amount of hydraulic oil supplied to the phase advancing chamber when the residual oil amount or the residual oil pressure is greater than or equal to a reference value at engine starting in comparison with a case in which the residual oil amount or the residual oil pressure is less than the reference value at engine starting.

3. The controller for a variable valve actuation device according to claim 2, wherein, after the starting of the internal combustion engine is initiated under a circumstance in which the residual oil amount or the residual oil pressure is less than the reference value, the phase locking mechanism locks the valve timing to the specific angular phase when the valve timing is advanced to the specific angular phase due to the cam torque variations.

4. The controller for a variable valve actuation device according to claim 2, wherein an operating state of the phase locking mechanism in which the valve timing is not locked to the specific angular phase is defined as a phase unlocking state, wherein the phase locking mechanism is in the phase unlocking state if the residual oil amount or the residual oil pressure is greater than or equal to the reference value at engine starting.

5. The controller for a variable valve actuation device according to claim 2, wherein a predetermined phase range that is a more advanced than the most retarded phase and includes the specific angular phase is defined as a specific phase range, wherein, after the starting of the internal combustion engine is initiated under a circumstance in which the residual oil amount or the residual oil pressure is greater than or equal to the reference value, the valve timing is held in the specific phase range by oil pressure of the phase changing mechanism when the valve timing is advanced to the specific phase range.

6. The controller for a variable valve actuation device according to claim 1, wherein the controller estimates at least one of the residual oil amount and the residual oil pressure at the starting of the engine based on a variation width of the valve timing at the starting of the engine.

7. The controller for a variable valve actuation device according to claim 1, wherein a history showing that a variation width of the valve timing is greater than or equal to a predetermined variation width at the last engine stopping transition is defined as a history at engine stopping, wherein, after the current starting of the internal combustion engine is initiated, the phase locking mechanism locks the valve timing to the specific angular phase if the valve timing is advanced to the specific angular phase due to the cam torque variations and the history at engine stopping.

8. The controller for a variable valve actuation device according to claim 1, wherein the controller estimates at least one of the residual oil amount and the residual oil pressure at the starting of the engine based on at least one of the residual oil amount and the residual oil pressure at the last stopping of the engine, and based on the outflow of hydraulic oil from the phase retarding chamber in a period from the last stopping of the engine to the starting of the engine.

* * * * *